US005378597A

United States Patent [19]

Kawabe et al.

[11] Patent Number: 5,378,597

[45] Date of Patent: Jan. 3, 1995

[54] SILVER HALIDE PHOTOGRAPHIC EMULSION CONTAINING A SPECIFIC DYE-GRAIN COMBINATION

[75] Inventors: Satomi Kawabe; Hiroyuki Hoshino, both of Hino; Syoji Matsuzaka, Hachioji, all of Japan

[73] Assignee: Konica Corporation, Tokyo, Japan

[21] Appl. No.: 235,245

[22] Filed: Apr. 29, 1994

Related U.S. Application Data

[63] Continuation of Ser. No. 881,814, May 12, 1992, abandoned.

[30] Foreign Application Priority Data

May 14, 1991 [JP] Japan ..... 3-109171

[51] Int. Cl.[6] ..... G03C 1/005; G03C 1/494

[52] U.S. Cl. ..... 430/567; 430/574

[58] Field of Search ..... 430/567, 574

[56] References Cited

U.S. PATENT DOCUMENTS

| | | | |
|---|---|---|---|
| 3,483,196 | 12/1969 | Jenkins et al. | 430/587 |
| 3,541,089 | 11/1970 | Heseltine et al. | 430/587 |
| 3,598,595 | 8/1971 | Mee et al. | 430/587 |
| 3,598,596 | 8/1971 | Chapman | 430/547 |
| 3,632,808 | 1/1972 | Brooker et al. | 430/606 |
| 3,907,575 | 9/1975 | Shiba et al. | 430/574 |
| 4,018,610 | 4/1977 | Hinata et al. | 430/574 |
| 4,152,163 | 5/1979 | Sato et al. | 430/574 |
| 4,179,296 | 12/1979 | Sato et al. | 430/574 |
| 4,518,689 | 5/1985 | Noguchi et al. | 430/574 |
| 4,571,380 | 2/1986 | Sasaki et al. | 430/574 |
| 5,041,366 | 8/1991 | Asano et al. | 430/574 |
| 5,057,409 | 10/1991 | Suga | 430/567 |

FOREIGN PATENT DOCUMENTS

| | | |
|---|---|---|
| 0273411 | 7/1988 | European Pat. Off. . |
| 0367540 | 5/1990 | European Pat. Off. . |
| 0410410 | 1/1991 | European Pat. Off. . |
| 43-4933 | 2/1943 | Japan . |
| 44-32753 | 12/1969 | Japan . |
| 47-8741 | 3/1972 | Japan . |
| 51-5781 | 2/1976 | Japan . |
| 52-23931 | 2/1977 | Japan . |
| 57-92523 | 6/1982 | Japan . |
| 58-92524 | 6/1983 | Japan . |
| 58-111935 | 7/1983 | Japan . |
| 58-111936 | 7/1983 | Japan . |
| 58-111937 | 7/1983 | Japan . |
| 58-113927 | 7/1983 | Japan . |
| 59-99433 | 6/1984 | Japan . |
| 60-42750 | 3/1985 | Japan . |
| 60-78445 | 5/1985 | Japan . |
| 63-167348 | 7/1988 | Japan . |
| 2-123347 | 5/1990 | Japan . |
| 2-162342 | 6/1990 | Japan . |
| 2162343 | 6/1990 | Japan . |

*Primary Examiner*—Janet C. Baxter
*Assistant Examiner*—J. Pasterczyk
*Attorney, Agent, or Firm*—Finnegan, Henderson Farabow, Garrett & Dunner

[57] ABSTRACT

Disclosed is a photographic silver halide emulsion comprising a tabular silver halide grains having at least two twin crystal planes, at least one of an unsymmetrical cyanine represented by Formula I, at least one of a symmetrical cyanine represented by Formula II-(a), and at least one of a symmetrical cyanine represented by Formula II-(b);

Formula I (a)

Formula II (b)

(Abstract continued on next page.)

-continued

Formula II

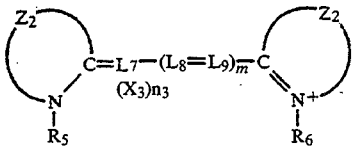

wherein $Z_1$ and $Z_2$ each represents a group of atoms necessary to form a naphthoxazole ring, a naphthoimidazole ring, a naphthoselenazole ring, a benzoxazole ring, a benzothiazole ring, a benzimidazole ring, a benzselenazole ring, $Z_1$ and $Z_2$ are not the same as each other, a heterocyclic ring formed by $Z_1$, $Z_2$ may have a substituent; $R_1$, $R_2$, $R_3$, $R_4$, $R_5$ and $R_6$ each represents an unsubstituted alkyl group or a substituted alkyl group; m represents an integer of 0 to 2, $L_1$ to $L_9$ each represents a methine group or a substituted group; $X_1$, $X_2$ and $X_3$ each represent a charge-balancing counter ion; $n_1$, $n_2$ and $n_3$ each represent an integer larger than 0 and necessary to neutralize the change of the whole molecule.

14 Claims, No Drawings

SILVER HALIDE PHOTOGRAPHIC EMULSION CONTAINING A SPECIFIC DYE-GRAIN COMBINATION

This application is a continuation of application Ser. No. 07/881,814 filed May 12, 1992now abandoned.

FIELD OF THE INVENTION

The present invention relates to a silver halide photographic emulsion and particularly to a silver halide photographic emulsion excellent in spectral sensitivity and storage stability.

BACKGROUND OF THE INVENTION

In recent years, photographic apparatus such as cameras have spread extensively, and the occasion to use a silver halide light-sensitive material was increased.

Under the circumstances, the improvement of silver halide light-sensitive materials toward a much higher sensitivity is strongly demanded.

One of the controlling factors to the sensitivity improvement of silver halide light-sensitive materials is in silver halide grains. Various attempts have been made to develop silver halide grains having high sensitivities.

Techniques have been studied to improve the sensitivity-to-size ratio per silver halide grain, and as one of such techniques, a technique to use tabular silver halide grains is disclosed in Japanese Pat . O.P.I. Pub. Nos. 111935/1983, 111936/1983, 111937/1983, 113927/1983, 99433/1984.

When these tabular silver halide grains are compared with the so-called regular silver halide crystal grains such as octahedrons, tetradecahedrons or hexahedrons, the surface area of a silver halide grain is larger in the same volume. Accordingly, it is understood that much more sensitizing dye can be adsorbed on the surface of a silver halide grain and a much higher sensitivity can be obtained.

On the other hand, development of spectral sensitizers has been made has been in order to attain a much higher spectral sensitivity. For example, as techniques to obtain a silver halide photographic light-sensitive material improved in spectral sensitivity in a green light area, combination of two types of oxacarbocyanines is disclosed, for example, in Japanese Pat. Exam. Pub. No. 32753/1969 and Japanese Pat. O.P.I. Pub. No. 23931/1977; combination of an oxacarbocyanine and a benzimidazolocarbocyanine is disclosed, for example, in Japanese Pat. O.P.I. Pub. No. 116646/1984; and combination of an oxacarbocyanine and an oxathiacarbocyanine is disclosed, for example, in Japanese Pat. O.P.I. Pub. Nos. 42750/1985 and 167348/1988.

Further, a silver halide photographic light-sensitive material improved in spectral sensitivity in a red light area, in which two types of thiacarbocyanines are combined, is disclosed, for example, in Japanese Pat. Exam. Pub. Nos. 4933/1968, 8741/1972 and 5781/1976.

Most of these conventional techniques, however, are liable to cause desensitization when applied to a silver halide light-sensitive material comprised of multiple silver halide emulsion layers.

The reason for the occurrence of such a disadvantage which scarcely appears in a monolayered configuration is not clear, but it can be attributed to the desorption or rearrangement of adsorbed dyes resulting from the multilayered configuration.

When these sensitizing dyes are added to a tabular grain silver halide emulsion, the adsorption of the dyes to silver halide grains does not increase despite of increase in grain surface area. As a result, the sensitization is limited to a lower level than expected.

In order to eliminate such disadvantages, there have been taken various measures to increase the adsorption of the dyes, such as modification of the halide composition in a silver halide emulsion or addition of halogens to an emulsion. But the modification of an emulsion changes the emulsion's ripening conditions, thereby adverse influences are exerted on the balance of photographic properties among layers and the preservability of an emulsion. Therefore, these methods are limited in effectiveness and cannot employ the merit of tabular silver halide grains adequately.

Under the circumstances, there has been desired a tabular silver halide emulsion which is free from the above problems and high in spectral sensitivity.

PROBLEMS INTENDED TO BE SOLVED BY THE INVENTION

Accordingly, the object of the present invention is to provide a tabular silver halide emulsion high in spectral sensitivity and excellent in preservability.

MEASURES TO SOLVE THE PROBLEMS

The present inventors have made a close study and found that the above object is attainable. That is, the object of the invention is achieved by use of (1) a silver halide photographic emulsion comprised mainly of tabular silver halide grains having at least two twin planes, which contains at least one of the unsymmetrical cyanines represented by Formula I, at least one of the symmetrical cyanines represented by Formula II and having one of the heterocyclic nuclei constituting the above unsymmetrical cyanines, and at least one of the symmetrical cyanines represented by Formula II and having the other one of the heterocyclic nuclei constituting the above unsymmetrical cyanines:

Formula I

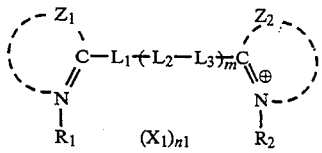

Formula II

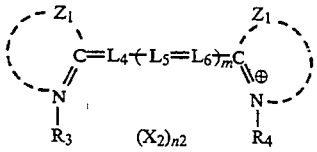

(a)

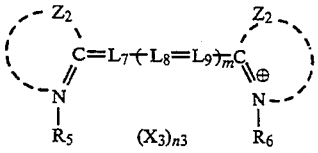

(b)

wherein $Z_1$ and $Z_2$ each represent a group of atoms necessary to form a naphthoxazole nucleus, a naphthothiazole nucleus, a naphthimidazole nucleus, a naphthoselenazole nucleus, a benzoxazole nucleus, a benzothiaz-

| Exemplified compounds | Structure |
|---|---|
| | Type (I) |
| I-1 | 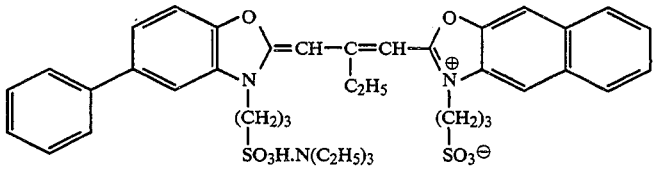 |
| I-3 | 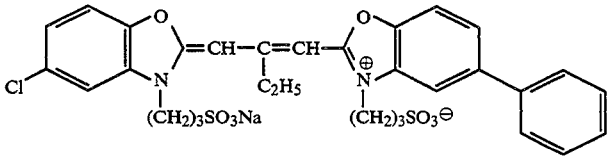 |
| I-10 | 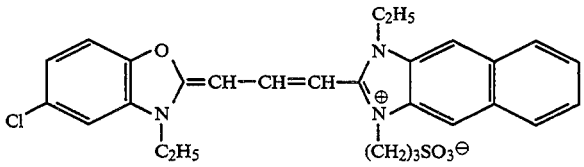 |
| I-28 | 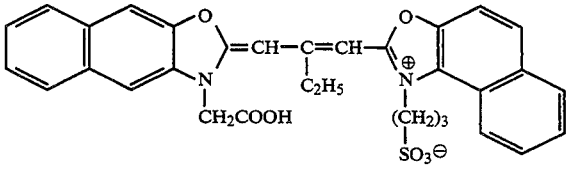 |
| I-30 | 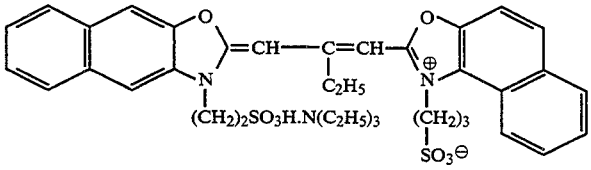 |
| I-44 | 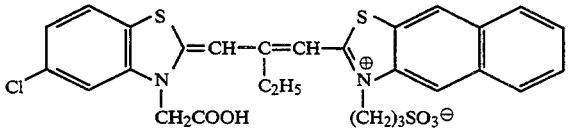 |
| I-54 | 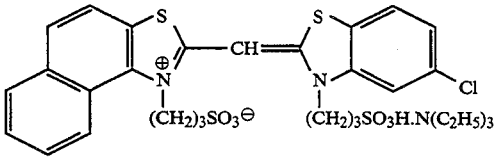 |
| I-64 | 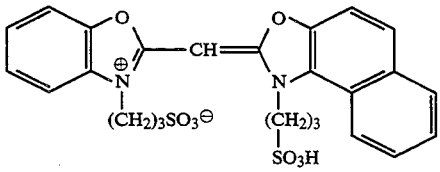 |

-continued
I-65
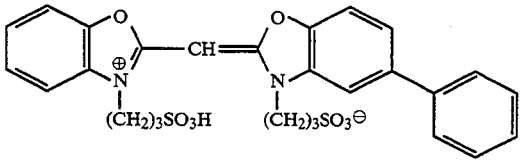
I-66
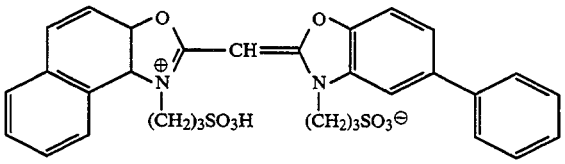
I-67
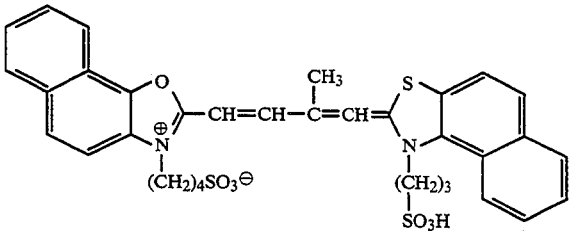
I-68
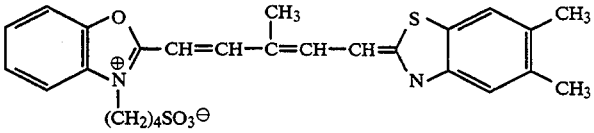
Type (II)
II-1
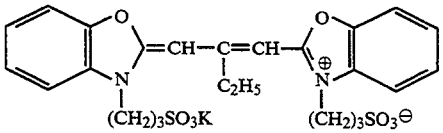
II-2
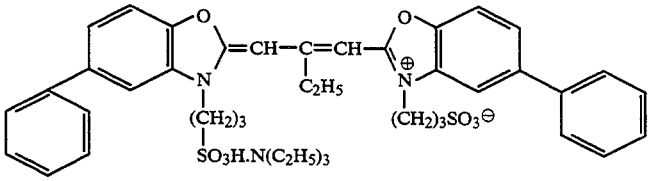
II-3
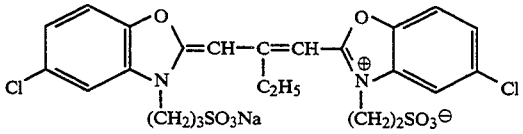
II-21
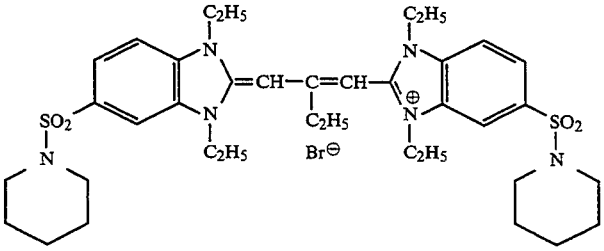

-continued
II-25
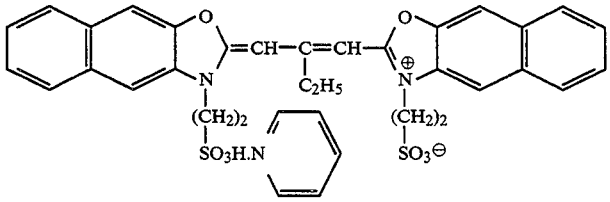
II-32
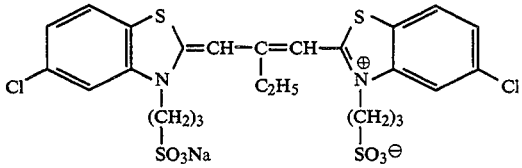
II-43
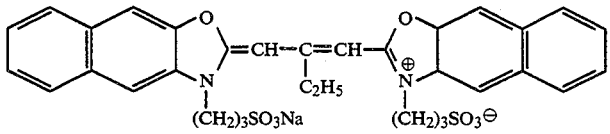
II-45
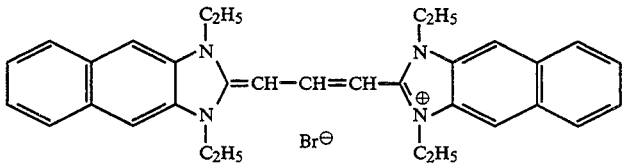
II-50
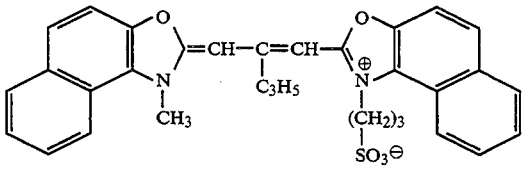
II-53
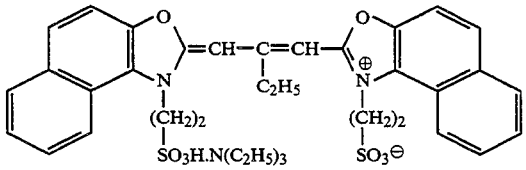
II-54
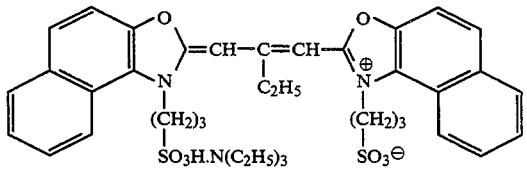
II-62
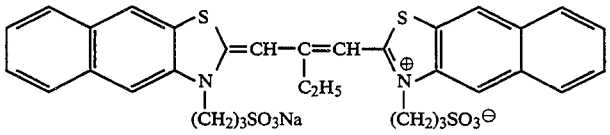
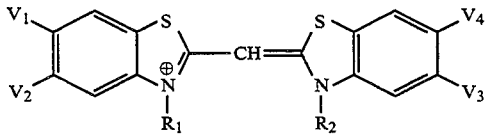
| No. | $V_1$ | $V_2$ | $V_3$ | $V_4$ | $R_1$ | $R_2$ |
|---|---|---|---|---|---|---|
| II-70 | H | Cl | Cl | H | $(CH_2)_3SO_3^{\ominus}$ | $(CH_2)_3SO_3Na$ |

-continued

| | | | | | | |
|---|---|---|---|---|---|---|
| II-71 | H | $OCH_3$ | $OCH_3$ | H | $(CH_2)_3SO_3^{\ominus}$ | $(CH_2)_3SO_3Na$ |
| II-72 | H | H | H | H | $(CH_2)CH(SO_3^{\ominus})CH_3$ | $CH_2CH{=}CH_2$ |
| II-73 | $CH_3$ | $CH_3$ | $CH_3$ | $CH_3$ | $(CH_2)_3SO_3^{\ominus}$ | $(CH_2)_3SO_3Na$ |
| II-74 | H | $CH_3$ | $CH_3$ | H | $(CH_2)_3SO_3^{\ominus}$ | $(CH_2)_3SO_3Na$ |
| II-75 | H | $OC_2H_5$ | $OC_2H_5$ | H | $(CH_2)_3SO_3^{\ominus}$ | $(CH_2)_3SO_3Na$ |

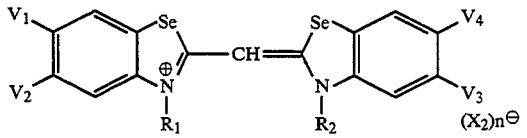

| No. | $V_1$ | $V_2$ | $V_3$ | $V_4$ | $R_1$ | $R_2$ | $X_2$ | n |
|---|---|---|---|---|---|---|---|---|
| II-76 | H | $OCH_3$ | $OCH_3$ | H | $(CH_2)_3SO_3^{\ominus}$ | $(CH_2)_3SO_3H$ | — | 0 |
| II-77 | H | $CH_3$ | $CH_3$ | H | $(CH_2)_3SO_3^{\ominus}$ | $(CH_2)_3SO_3H$ | — | 0 |
| II-78 | H | $OCH_3$ | $OCH_3$ | H | $(CH_2)_3SO_3^{\ominus}$ | $(CH_2)_3SO_3Na$ | — | 0 |
| II-79 | H | Cl | Cl | H | $(CH_2)_3SO_3^{\ominus}$ | $CH_2COOH$ | — | 0 |
| II-80 | H | H | H | H | $-C_2H_5$ | $C_2H_5$ | Br | 1 |

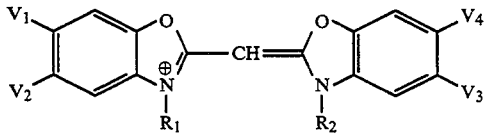

| No. | $V_1$ | $V_2$ | $V_3$ | $V_4$ | $R_1$ | $R_2$ |
|---|---|---|---|---|---|---|
| II-81 | H | 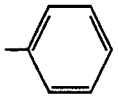 | 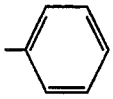 | H | $(CH_2)_3SO_3^{\ominus}$ | $(CH_2)_3SO_3Na$ |
| II-82 | H | 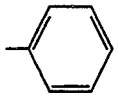 | 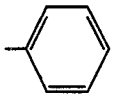 | H | $(CH_2)_3SO_3^{\ominus}$ | $(CH_2)_3SO_3Na$ |
| II-83 | H | Cl | Cl | H | $(CH_2)_3SO_3^{\ominus}$ | $(CH_2)_3SO_3Na$ |
| II-84 | H | H | H | H | $(CH_2)_3SO_3^{\ominus}$ | $(CH_2)_3SO_3H$ |

II-85

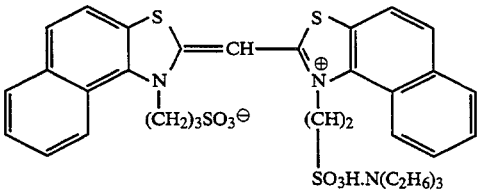

II-89

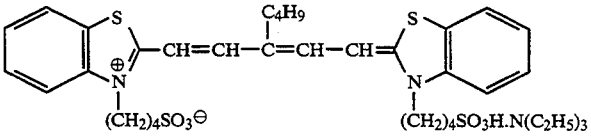

II-90

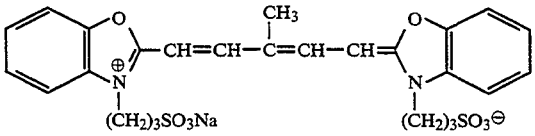

-continued

II-91

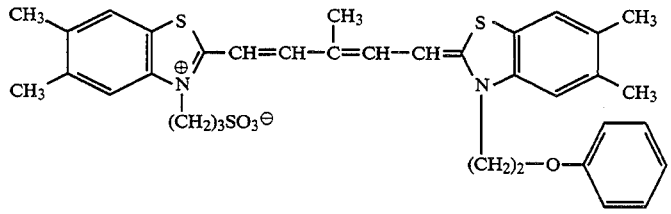

II-92

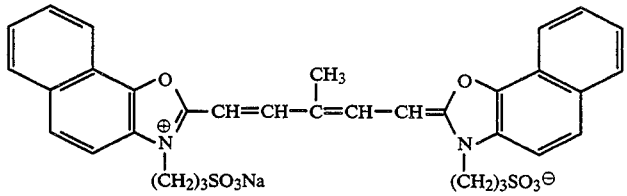

II-93

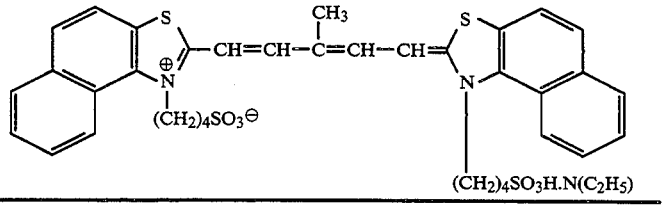

Besides the above sensitizing dyes, other usable dyes can be seen in the following Japanese Patent O.P.I. Publications.

As the sensitizing dye represented by Formula I, the following ones can be exemplified.

Ones denoted by III-2, III-4 on page 6, III-5 to III-26 on page 7 and III-27, III-28 on page 9 of Japanese Pat. O.P.I. Pub. No. 123347/1990; ones denoted by III-2, III-4 to III-11 on page 5 of Japanese Pat. O.P.I. Pub. No. 162342/1990; ones denoted by III-1 to III-5, III-7 to III-9 on page 5 and III-10 to III-13 on page 6 of Japanese Pat. O.P.I. Pub. No. 162343/1990; and ones denoted by II-8, II-10 on page 24 and II-13, II-15, II-16, II-17 on page 26, II-26 to II-28 on page 27, II-34 on page 28 and II-38 on page 29 of Japanese Pat. O.P.I. Pub. No. 160538/1990.

The following are examples of the sensitizing dye represented by Formula II.

Ones denoted by I-4 to I-20 on page 5 and II-5, II-7 to II-9 on page 6 of Japanese Pat. O.P.I. Pub. No. 123347/1990; ones denoted by I-1 to I-3, I-5 to I-8, II-1, II-3 to II-5 on page 4 and II-6 to II-11 on page 6 of Japanese Pat. O.P.I. Pub. No. 162342/1990; ones denoted by I-1, I-2, I-4 to I-13 on page 4 and II-2 to II-8 on page 5 of Japanese Pat. O.P.I. Pub. No. 162342/1990; and ones denoted by II-11 on page 24, II-25 on page 27 and II-31 on page 28 of Japanese Pat. Appln. No. 160538/1990.

Next, the tabular silver halide emulsion used in the invention, which is comprised of twin crystals having at least two twin plains, is described.

The term "twin" means a silver halide crystal having at least one twin plane in a grain, and the classification of twin forms is described in detail in E. Klein and E. Moiser, Photographische Korrespondenz, vol. 99, p. 99 and vol. 100, p. 57. Two or more of twin planes contained in a twin crystal may, or may not, be parallel to each other.

In the invention, it is necessary for the silver halide emulsion to be comprised of grains having at least two twin plains, and these twin planes are usually parallel to each other. Preferably, these grains have an even number of twin planes; particularly preferably, these have two twin planes.

The term "comprised mainly of twin crystals having two or more of parallel twin planes" used in the invention means that when the number of grains is counted from the most abundant grain, grains having two or more parallel twin planes account for 50% or more, preferably 60% or more and especially 70% or more in number.

The twin crystals used in the invention may be comprised of {111} faces, {100} faces or both of the two, but those comprised of {111} faces are preferred.

When a twin crystal having two or more twin planes is projected perpendicularly to its parallel twin planes, the ratio of the diameter in terms of a circle to the interval (thickness) between the two parallel surfaces is usually 1 to 20, preferably 1.2 to 8 and especially 1.5 to 5.0.

In the invention, the term "comprised mainly of twin crystals" means that the number of twin crystal grains accounts for 60% or more, preferably 80% or more and especially 95 to 100% of the total number of grains.

The silver iodobromide emulsion comprised mainly of twin crystals according to the invention is preferably a monodispersed one, for reasons that chemical ripening and spectral ripening can be uniformly carried out among the grains so that the sensitivity and preservability are improved.

Among monodispersed silver halide emulsions usable in the invention, particularly preferred ones are those emulsions which are disclosed in Japanese Publication O.P.I. Publication No. 142440/1991, from the 1st line from the bottom on page 6 to the 3rd line on page 8.

The average size of silver halide grains contained in the emulsion of the invention is usually 0.1 to 10.0 μm, preferably 0.2 to 5.0 μm and especially 0.3 to 3.0 μm, along the edge of a cube of identical volume.

The silver halide composition of a photographic emulsion of the invention may be any of silver bromide, silver chloride, silver chlorobromide, silver iodobromide and silver chloroidobromide.

Of these silver halides, silver iodobromide is particularly preferred for its capability of providing a high sensitivity.

It is preferable that the silver halide emulsion of the invention have an average silver iodide content of 4 to 20 mol%, especially 5 to 15 mol %.

In order to obtain a high sensitivity, it is preferable that the silver halide emulsion of the invention be comprised of grains of core/shell structure having a high silver iodide content phase in the grain.

The silver iodide content in the high silver iodide content phase is usually 15 to 45 mol %, preferably 20 to 42 mol % and especially 25 to 40 mol %.

In the silver halide grain of the invention having a high silver iodide content phase internally, the high silver iodide content phase is covered with a low silver iodide content phase, which is lower than the high silver iodide content phase in silver iodide content.

The average silver iodide content of the low silver iodide content phase, which constitutes the outermost phase, is preferably not more than 6 mol % and especially 0 to 4 mol % in order to obtain an adequate chemical sensitization and developability. Further, there may be provided another silver iodide content phase (an intermediate phase) between the outermost phase and the high silver iodide content phase.

The silver iodide content of the intermediate phase is preferably 10 to 22 mol % and especially 12 to 20 mol %.

It is preferable that the difference in silver iodide content between the outermost phase and the intermediate phase, and that between the intermediate phase and the internal high silver iodide content phase, be not less than 6 mol % and especially not less than 10 mol %, respectively.

In the above mode, there may be further present other silver halide phases at the center of the internal high silver iodide content phase, between the internal high silver iodide content phase and the intermediate phase, and between the intermediate phase and the outermost phase.

The volume of the outermost phase is desirably 4 to 70%, more desirably 10 to 50% of the whole grain volume; the volume of the high silver iodide content phase is desirably 10 to 80%, more desirably 20 to 50% and most desirably 20 to 45% of the whole grain volume; and the volume of the intermediate phase is desirably 5 to 60% and more desirably 20 to 55% of the whole grain volume.

These phases may be any of a single phase having a uniform composition, a group of phases comprised of plural phases each having a uniform composition which changes stepwise, a continuous phase in which the composition changes continuously, and a mixture thereof.

In another mode of the silver halide emulsion of the invention, the silver iodide localized in a grain does not form a substantially uniform phase, and the silver iodide content changes continuously from the center to the peripheral portion of the grain. In this case, it is preferable that the silver iodide content decrease monotonically from the point where the silver iodide content is the largest to the peripheral portion.

The silver iodide content at the point where it is the largest is preferably 15 to 45 mol %, especially 25 to 40 mol %.

Further, the silver halide composition in the outermost phase is preferably silver iodobromide or silver chlorobromide each having a silver iodobromide content not more than 6 mol %, and silver iodobromide containing 0 to 4 mol % of silver iodide is particularly preferred.

In the preparation of the silver halide emulsion of the invention, it is preferable that halide ions be fed as usually practiced, in the form of an aqueous solution of an alkali halide such as KI, NaI, KBr or NaBr, or a mixed solution thereof, or in the form of a fine grain silver halide. The method of feeding a fine grain silver halide is favorably used, because it makes the surface state of grains uniform and allows chemical sensitization and spectral sensitization to be uniformly performed among the grains or inside of the grains, whereby the sensitivity and fog are improved.

The composition of such a fine grain silver halide may be any of silver chloride, silver bromide, silver iodide, silver chlorobromide, silver iodobromide and silver chloroidobromide. But silver bromide and silver iodobromide are preferred for their capabilities of giving a better chemical sensitization.

The preparation of silver halide grains and the preparation of a fine grain silver halide therefrom to feed halide ions in the form of a fine grain silver halide can be practiced by referring to the method described in Japanese Pat. O.P.I. Pub. No. 166442/1990, from the 5th line from the bottom of the lower right column on page 4 to the 1st line of the upper right column on page 9. To feed iodine ions, there can be used a method comprising the steps of feeding iodine in the form of silver iodide fine grains and feeding an aqueous solution of an alkali halide, such as KBr or NaBr, and an aqueous solution of silver nitrate.

As high-molecular weight compounds acting as a protective colloid to the silver halide grains used in the invention, there can be used the following compounds, which are described from the 4th line of the upper left column on page 7 to the 5th line of the upper left column on page 8 of Japanese Pat. O.P.I. Pub. No. 166442/1990.

a. Polyacrylamides
b. Polyacryl aminopolymers
c. Thioether-containing polymers
d. Polyvinyl alcohols
e. Acrylic acid polymers
f. Hydroquinone-containing polymers.

A low-molecular weight gelatin used in the invention has an average molecular weight of preferably not more than 30,000, especially not more than 10,000.

In preparing the low-molecular weight gelation used in the invention, the description in R. J. Cox, Photographic Gelatin II, Academic Press, London, 1976, pp. 233–251 and pp. 335–346 can be referred to.

Incidentally, when method [B] for preparing silver halide grains (described from the 8th line from the bottom of the upper right column on page 8 of the above Japanese Patent O.P.I. Publication), it is preferable that a fine grain silver halide prepared be preserved at a temperature lower than 20° C. until the addition of it is completed.

As silver halide solvents, there may be used those water-soluble bromides, water-soluble chlorides, thiocyanates, ammonia, thioethers and thiourea which are described from the 1st line from the bottom of the lower left column-to the 4th line of the lower right column on page 8 of the above Japanese Patent O.P.I. Publication.

The silver halide grains according to the invention can be prepared by the neutral method, the acid method, the ammoniacal method, the single jet method, the reverse jet method, the double jet method or the controlled double jet method described in literature such as T. H. James, The Theory of the Photographic Process, 4th edition, Macmillan Publishing Co., 1977, pp. 38–104.

It is preferable that at least one kind of metal ions selected from cadmium salts, zinc salts, lead salts, thallium salts, iridium salts (including complex salts), rhodium salts (including complex salts) and iron salts (including complex salts) be added to the silver halide emulsion, in the process to form grains and/or in the process to grow grains, in order to have these metal elements present inside of the grains and/or on the surface of the grains. Among them, rhodium gives a particularly high contrast, and iridium can improve a high intensity reciprocity law failure to give a high contrast; accordingly, doping with these metal ions is preferred. Further, it is preferable to form reduction-sensitized specks inside of the grains and/or on the surface of the grains by keeping the emulsion in a reducing environment.

It is preferable for the emulsion of the invention to be subjected to desalting according to a conventional method, after the emulsion is provided with the prescribed grain conditions. The desalting may be carried by the method which employs an aggregating gelatin agent used in desalting of silver halide seed grains, the noodle washing method which is performed using a gelatin gel, the coagulation method which uses inorganic salts consisting of a polyvalent anion such as sodium sulfate, anionic surfactants, anionic polymers including polystyrenesulfonate, or the flocculation method which employs gelatin derivatives such as acylated gelatin, carbamoylated gelatin.

The silver halide grains desalted as above are dispersed again in gelatin, so that a silver halide emulsion is prepared.

The silver halide emulsion of the invention can be favorably used in a silver halide photographic light-sensitive material.

In making a silver halide photographic light-sensitive material by use of the silver halide emulsion of the invention, the emulsion is subjected to physical ripening, chemical ripening and spectral sensitization before it is used.

In these processes, there can be used the additives described in Research Disclosure Nos. 17643, 18716 and 308119 (hereinafter abbreviated to RD17643, RD18716 and RD308119, respectively).

The locations of the relevant descriptions are as follows:

| [Item] | [Page of RD308119] | [RD17643] | [RD18716] |
|---|---|---|---|
| Chemical sensitizer | 996 III Sec. A | 23 | 648 |
| Spectral sensitizer | 996 IV Sec. A, B, C, D, H, I, J, K | 23–24 | 648–9 |
| Supersensitizer | 996 IV Sec. A–E, J | 23–24 | 648–9 |
| Antifoggant | 998 VI | 24–25 | 649 |
| Stabilizer | 998 VI | 24–25 | 649 |

The above numbers of Research Disclosure also describe conventional photographic additives usable in making a color photographic light-sensitive material using the silver halide emulsion of the invention. The following list shows the locations of the relevant descriptions.

| [Item] | [Page of RD308119] | [RD17643] | [RD18716] |
|---|---|---|---|
| Anti-color-mixing agent | 1002 VII Sec. I | 25 | 650 |
| Dye image stabilizer | 1001 VII Sec. J | 25 | |
| Whitening agent | 998 V | 24 | |
| UV absorbent | 1003 VIII Sec. CXIII Sec. C | 25–26 | |
| Light absorbent | 1003 VIII | 25–26 | |
| Light scattering agent | 1003 VIII | | |
| Filter dye | 1003 VIII | 25–26 | |
| Binder | 1003 IX | 26 | 651 |
| Antistatic agent | 1006 XIII | 27 | 650 |
| Hardener | 1004 X | 26 | 651 |
| Plasticizer | 1006 XII | 27 | 650 |
| Lubricant | 1006 XII | 27 | 650 |
| Surfactant, coating aid | 1005 XI | 26–27 | 650 |
| Matting agent | 1007 XVI | | |
| Developer (contained in light-sensitive material) | 1011 XX Sec. B | | |

Various couplers can be used in the manufacture of a color photographic light-sensitive material using the silver halide photographic emulsion of the invention, typical examples of such couplers are also described in the above numbers of Research Disclosure. The locations of the relevant descriptions are as follows:

| [Item] | [Page of RD308119] | [RD17643] |
|---|---|---|
| Yellow coupler | 1001 VII Sec. D | VII Sec. C–G |
| Magenta coupler | 1001 VII Sec. D | VII Sec. C–G |
| Cyan coupler | 1001 VII Sec. D | VII Sec. C–G |
| Colored coupler | 1002 VII Sec. G | VII Sec. G |
| DIR coupler | 1001 VII Sec. F | VII Sec. F |
| BAR coupler | 1002 VII Sec. F | |
| Other useful group releasing coupler | 1001 VII Sec. F | |
| Alkali-soluble coupler | 1001 VII Sec. E | |

The additives, usable in making a color photographic light-sensitive material employing the silver halide photographic emulsion of the invention, can be added by the dispersing method or the like described in XIV of RD308119.

In making a color photographic light-sensitive material by use of the silver halide emulsion of the invention, there may be used the supports described on page 28 of RD17643, pages 647–8 of RD18716 and in XVII of RD308119.

In the color photographic light-sensitive material using a photographic emulsion of the invention, there may be provided auxiliary layers such as a filter layer and an intermediate layer described in Section K of VII in RD308119.

The color photographic light-sensitive material using a photographic emulsion of the invention may have various layer configurations, such as conventional layer order, inverted layer order and unit layer structure described in Section K of VII in RD308119.

The silver halide emulsion of the invention can be applied to a variety of Light-sensitive materials represented by color negative film for popular use or for movie, color reversal film for slide or for TV, color paper, color positive film and color reversal paper.

A color light-sensitive material using the silver halide photographic emulsion of the invention can be processed by conventional methods described on pages 28–29 of RD17643, page 647 of RD18716 and in XVII of RD308119.

EXAMPLES

Typical examples of the invention are described hereunder.

In all the examples, the amount in which each component of a silver halide light-sensitive material is added, is given in grams per square meter unless otherwise indicated. The amounts of silver halide and colloidal silver are shown in amounts of silver present. The amount of a sensitizing dye is shown in mols per mol of silver halide contained in the same layer.

Preparation Example 1

A comparative silver halide emulsion, emulsion EM-1, was prepared by use of the following solutions. This emulsion was comprised of core/shell-type octahedral silver halide crystal grains each having a high iodide content layer internally. The grains of the emulsion had an average size of 1.2 μm when converted into cubes, an average iodide content of 8.0 mol % and a variation coefficient of the gain size of 27%.

| | |
|---|---|
| Solution A-1 | |
| Seed emulsion* | equivalent to 0.16 mol of AgX** |
| Ossein gelatin | 296.8 g |
| Sodium polyisopropylene-disuccinate 10% aqueous ethanol solution | 30 ml |
| Deionized water | 7285 ml |
| 56% Acetic acid aqueous solution | 1325 ml |
| 28% Aqueous ammonia | 880 ml |

Notes
*: comprised of monodispersed spherical grains having a grain size distribution of 20%, an average size of 0.27 μm and an average AgI content of 2 mol %.
**: AgX means silver halide, the same applies hereinafter.

| | |
|---|---|
| Solution B-1 | |
| Ossein gelatin | 178 g |
| KBr | 1237.5 g |
| Deionized water | 2389 ml |
| Solution C-1 | |
| $AgNO_3$ | 1443 g |
| 28% Aqueous ammonia | 1130.4 ml |
| Water is added to make | 2823.5 ml |
| Solution D-1 | |
| AgI emulsion (average grain size: 0.060 μm) | 1252.2 ml* |
| 4-Hydroxy-6-methyl-1,3,3a,7-tetrazaindene** | 5.22 g |
| Deionized water | 22.4 ml |

Notes
*: equivalent to 0.75 mol of AgX.
**: hereinafter referred to as TAI.

| | |
|---|---|
| Solution E-1 | |
| 20% KBr aqueous solution | amount necessary to adjust pAg |
| Solution F-1 | |
| 56% Acetic acid | amount necessary to adjust pH |

Emulsion EM-1 was prepared using the above solutions in the following procedure. Solution B-1, solution C-1 and solution D-1 were added to solution A-1 by the double-jet mixing method at 60° C. using a mixing stirrer shown in Japanese Pat. O.P.I. Pub. Nos. 92523/1982 and 92524/1982. During the addition, the pAg, the pH and the addition rate of each solution were controlled as shown in Tables 1 and 2.

TABLE 1

| Time (min) | Addition rate (ml/min) B-1 | C-1 | D-1 |
|---|---|---|---|
| 0 | 3.7 | 3.9 | 0 |
| 21.5 | 10.0 | 10.5 | 0 |
| 32.9 | 15.1 | 15.9 | 0 |
| 45.1 | 6.9 | 7.3 | 0 |
| 65.5 | 4.9 | 5.2 | 15.8 |
| 82.9 | 5.6 | 5.9 | 18.0 |
| 97.9 | 9.6 | 10.1 | 6.3 |
| 113.3 | 23.9 | 13.7 | 2.4 |
| 117.9 | 72.6 | 39.2 | 6.8 |
| 121.2 | 10.1 | 49.2 | 8.6 |
| 123.9 | 61.6 | 59.2 | 0 |
| 126.4 | 65.5 | 6.7 | 0 |
| 128.8 | 69.2 | 64.2 | 0 |
| 130.3 | 71.7 | 66.5 | 0 |
| 132.5 | 75.2 | 69.8 | 0 |
| 134.6 | 78.7 | 73.0 | 0 |
| 138.5 | 85.5 | 79.0 | 0 |

TABLE 2

| Time (min) | 0 | | 100.0 | | 102.1 | | 122.1 | | 130.3 | | 138.5 |
|---|---|---|---|---|---|---|---|---|---|---|---|
| pH | 7.0 | → | 7.0 | ↓ | 6.0 | → | 6.0 | → | 6.0 | → | 6.0 |
| pAg | 7.8 | → | 7.8 | ↓ | 9.8 | ↘ | 10.1 | → | 10.1 | → | 10.1 |

The meaning of each arrow is as follows: → to maintain pH or pAg constant, ↓ to change pAg rapidly, ↘ to change pAg gradually The control of the pAg and the pH during the addition was made by varying the flows of solution E-1 and solution F-1 using a roller tube pump of variable flow type.

The silver halide grains obtained were subjected to desalting and washing in a usual manner and then dispersed in an aqueous solution containing 93.0 g of ossein gelatin. Subsequently, the total volume was adjusted to 4500 ml with deionized water to obtain emulsion EM-1.

Preparation Example 2

A silver halide emulsion of the invention, emulsion EM-2, was prepared by use of the following solutions. The seed emulsion used was prepared according to the method for preparing spherical twin seed emulsions described from the 8th line from the bottom on page 33 to the 3rd line from the bottom on page 34 of Japanese Patent Publication O.P.I. Publication No. 241336/1991. This emulsion was comprised of core/shell-type tabular silver halide grains each having two parallel twin planes and a high iodide content layer internally. These silver halide grains had an average grain size of 1.2 μm in terms of cubes, an average iodide content of 8.0 mol %, an average aspect ratio of 3 and a monodispersity of 17%.

| | |
|---|---|
| Solution A-2 | |
| Seed emulsion (average grain size: 0.315 μm, average AgI content 1.4 mol %) | equivalent to 0.19 mol of AgX |
| Ossein gelatin | 536.3 g |
| Sodium polyisopropylene-disuccinate 10% aqueous ethanol solution | 30 ml |
| Deionized water | 8573.0 ml |
| 56% acetic acid aqueous solution | 1500 ml |
| 29% aqueous ammonia | 1056 ml |
| Solution B-2 | |
| Ossein gelatin | 320 g |
| KBr | 1485.5 g |

-continued

| | |
|---|---|
| Deionized water | 2788.7 ml |
| Solution C-2 | |
| $AgNO_3$ | 1685 g |
| 28% Aqueous ammonia | 1320.6 ml |
| Water is added to make | 2823.5 ml |
| Solution D-2 | |
| AgI emulsion (average grain size: 0.060 μm) | equivalent to 0.84 mol of AgX |
| 4-Hydroxy-6-methyl-1,3,3a, 7-tetrazaindene (TAI) | 5.22 g |
| Deionized water | 22.4 ml |
| Solution E-2 | |
| 20% KBr aqueous solution | amount necessary to adjust pAg |
| Solution F-2 | |
| 56% acetic acid | amount necessary to adjust pH |

Using the above solutions, emulsion EM-2 was prepared in the following procedure. That is, solution B-2, solution C-2 and solution D-2 were added to solution A-2 by the double-jet mixing method at 60° C. using a mixing stirrer shown in Japanese Pat. O.P.I. Pub. Nos. 92523/1982 and 92524/1982. While the addition was continued, the pAg, the pH and the addition rate of each solution were controlled as shown in Table 3.

TABLE 3-(1)

| Time (min) | Addition rate (ml/min) B-2 | C-2 | D-2 |
|---|---|---|---|
| 0 | 3.6 | 3.8 | 0 |
| 39.6 | 2.7 | 2.8 | 2.1 |
| 89.53 | 2.6 | 2.8 | 7.2 |
| 126.5 | 3.4 | 3.5 | 9.2 |
| 156.5 | 4.8 | 5.0 | 7.3 |
| 186.2 | 19.8 | 7.2 | 4.7 |
| 200.7 | 15.1 | 15.0 | 8.9 |
| 208.7 | 29.7 | 29.9 | 8.1 |
| 212.6 | 60.3 | 60.7 | 9.2 |
| 219.9 | 15.0 | 27.5 | 0 |
| 227.6 | 34.2 | 35.9 | 0 |
| 238.5 | 57.5 | 60.3 | 0 |
| 245.8 | 67.4 | 70.8 | 0 |

TABLE 3-(2)

| Time (min) | 0 | | 166.3 | | 192.3 | | 200 | | 210 | | 245.8 |
|---|---|---|---|---|---|---|---|---|---|---|---|
| pH | 6.5 | → | 6.5 | → | 6.5 | → | 6.5 | → | 6.5 | ↗ | 6.8 |
| pAg | 8.4 | → | 8.4 | ↗ | 9.2 | → | 9.2 | → | 9.2 | → | 9.2 |

→ means than pH or pAg was kept constant,
↗ means to raise it gradually

The control of the pAg and the pH during the double-jet mixing was made by varying the addition rates of solution E-2 and solution F-2 using a variable flow roller tube pump.

The silver halide grains obtained were subjected to desalting and washing in a usual manner and dispersed in an aqueous solution containing 93.0 g of ossein gelatin. Then, the total volume was adjusted to 4500 ml with deionized water to obtain emulsion EM-2.

Preparation Example 3

To prepare emulsion EM-3, the seed grains were grown to a size of 1.1 μm in a similar manner as in Preparation example 2, after adjusting the EAg to 23 mV, solution G-3 was added thereto over a period of 10 minutes at a constant rate till the grains were grown to 1.2 μm size, then the grains were subjected to desalting and adjustment as in Preparation example 2 . Emulsion EM-3 thus obtained was comprised of core/shell-type tabular silver halide grains each having two parallel twin planes and a high iodide content layer internally. These silver halide grains had an average grain size of 1.2 μm in terms of cubes, an average iodide content of 8.0 mol %, an average aspect ratio of 3 and a variation coefficient of the grain size of 16%.

| | |
|---|---|
| AgBr fine grains (average equivalent to grain size: 0.093 μm) | 2.5 mols of AgX |

Example 1

Sensitizing dyes represented by Formulas I and II were added to the respective emulsions prepared in Preparation examples 1 and 2, Separately, the following sensitizing dyes irrelevant to the invention (hereinafter referred to as a comparative dye) were added to the above emulsions.

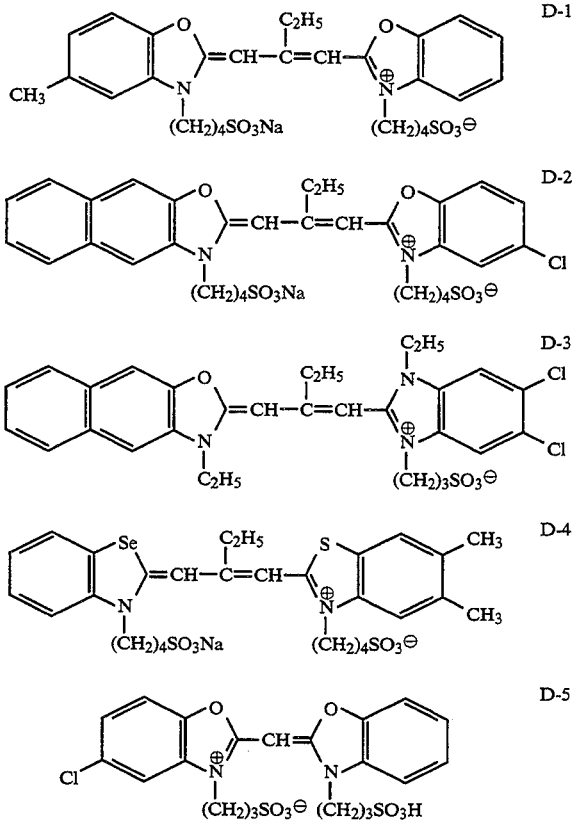

Subsequently, TAI, sodium thiosulfate, chloroauric acid and ammonium thiocyanate were added to the respective emulsions, then the emulsions were subjected to chemical ripening and spectral sensitization under optimum conditions.

Next, there were added to each emulsion proper amounts of TAI and 1-phenyl-5-mercapto-tetrazole as stabilizers, saponin as a coating aid and 1,2-bis(vinylsulfonyl)ethane as a hardener. Further, a dispersion consisting of the following couplers M-1 and AS-1, dodecyl gallate, tricresyl phosphate, ethyl acetate, sodium triisopropylnaphthalenesulfonate and gelatin was added thereto.

M-1

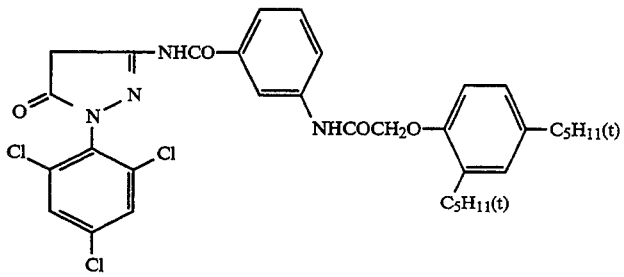

AS-1

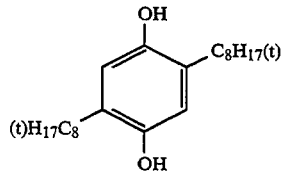

The emulsions prepared as above were each coated and dried on a cellulosetriacetate film support, so that samples 1 to 18 were prepared.

Each sample was divided into two portions: one portion was preserved for 3 days in natural environment and then used as the fresh sample, the other portion was preserved for 3 days in a thermo-hygrostat of 50° C., 80% RH to evaluate the preservability as a light-sensitive material and the desorption of sensitizing dyes from silver halide grains.

Subsequently, each sample was wedgewise exposed in 1/50 second through a green filter and then subjected to color negative development under the following conditions.

| Processing conditions | |
|---|---|
| Process (at 38° C.) | Processing time |
| Color developing | 3 min 15 sec |
| Bleaching | 6 min 30 sec |
| Washing | 3 min 15 sec |
| Fixing | 6 min 30 sec |
| Washing | 3 min 15 sec |
| Stabilizing | 1 min 30 sec |

The compositions of the processing solutions used in the respective processes are as follows:

| Color developer | |
|---|---|
| 4-Amino-3-methyl-N-ethyl-N-(β-hydroxyethyl)-aniline sulfate | 4.8 g |
| Anhydrous sodium sulfite | 0.14 g |

-continued

| | |
|---|---|
| Hydroxylamine ½ sulfate | 1.98 g |
| Sulfuric acid | 0.74 mg |
| Anhydrous potassium carbonate | 28.85 g |
| Anhydrous potassium hydrogensulfate | 3.46 g |
| Anhydrous potassium sulfite | 5.10 g |
| Potassium bromide | 1.16 g |
| Potassium chloride | 0.14 g |
| Trisodium nitrilotriacetate (monohydrate) | 1.20 g |
| Potassium hydroxide | 1.48 g |
| Water is added to make 1 liter. | |
| Bleacher | |
| Ammonium ferric ethylenediaminetetracetate | 100.0 g |
| Diammonium ethylenediaminetetracetate | 10.0 g |
| Ammonium bromide | 150.0 g |
| Glacial acetic acid | 10 ml |
| Water is added to make 1 liter, then the pH is adjusted to 6.0 with aqueous ammonia. | |
| Fixer | |
| Ammonium thiosulfate | 175.0 g |
| Anhydrous sodium sulfite | 8.6 g |
| Sodium metasulfite | 2.3 g |
| Water is added to make 1 liter, then the pH is adjusted to 6.0 with acetic acid. | |
| Stabilizer | |
| Formalin (38% aqueous solution) | 1.5 ml |
| Koniducks TM (product of Konica Corp.) | 7.5 ml |
| Water is added to make 1 liter. | |

For each color image obtained, sensitivity and fog were determined by sensitometry using a green filter.

The sensitivity was determined from the exposure necessary to give an optical density of [fog+0.1]. The results of the sensitometry are shown in Tables 4 and 5.

TABLE 4

| Sample | | Sensitizing dye and its addition amount (mol/mol AgX) | | | | | | Fresh | | Preserved for 3 days at 50° C., 80% RH | | |
|---|---|---|---|---|---|---|---|---|---|---|---|---|
| | | Formula I | | Formula II | | | | | | | | |
| No | Emulsion | No | Amount | No. | Amount | No. | Amount | Fog | Sensitivity | Fog | Sensitivity | Classification |
| 1 | Em-1 | — | — | II-2 | A | II-43 | A | 0.08 | 100 | 0.23 | 70 | Comparison |
| 2 | Em-1 | I-1 | A | — | — | II-43 | A | 0.08 | 100 | 0.22 | 70 | Comparison |
| 3 | Em-1 | I-1 | A | II-2 | A | — | — | 0.08 | 105 | 0.22 | 70 | Comparison |
| 4 | Em-1 | D-1 | B | II-2 | B | II-43 | B | 0.09 | 100 | 0.22 | 75 | Comparison |
| 5 | Em-1 | I-1 | B | II-2 | B | II-43 | B | 0.08 | 110 | 0.22 | 90 | Comparison |
| 6 | Em-1 | I-1 | C | II-2 | C | II-43 | C | 0.09 | 100 | 0.24 | 70 | Comparison |
| 7 | Em-1 | I-1 | D | II-2 | D | II-43 | D | 0.09 | 80 | 0.26 | 55 | Comparison |
| 8 | Em-2 | — | — | II-2 | A | II-45 | A | 0.08 | 110 | 0.22 | 85 | Comparison |
| 9 | Em-2 | — | — | II-2 | E | II-43 | E | 0.09 | 105 | 0.24 | 80 | Comparison |

TABLE 5

| Sample | | Sensitizing dye and its addition amount (mol/mol AgX) | | | | | | Fresh | | Preserved for 3 days at 50° C., 80% RH | | |
|---|---|---|---|---|---|---|---|---|---|---|---|---|
| | | Formula I | | Formula II | | | | | | | | |
| No | Emulsion | No | Amount | No. | Amount | No. | Amount | Fog | Sensitivity | Fog | Sensitivity | Classification |
| 10 | Em-2 | — | — | II-2 | F | II-43 | F | 0.11 | 105 | 0.27 | 75 | Comparison |
| 11 | Em-2 | I-1 | A | II-2 | A | — | — | 0.08 | 110 | 0.22 | 80 | Comparison |
| 12 | Em-2 | I-1 | A | — | — | II-43 | A | 0.08 | 115 | 0.22 | 80 | Comparison |
| 13 | Em-2 | D-1 | B | II-2 | B | II-43 | B | 0.09 | 110 | 0.21 | 90 | Comparison |

TABLE 5-continued

| Sample No | Emulsion | Sensitizing dye and its addition amount (mol/mol AgX) Formula I No | Amount | Formula II No. | Amount | No. | Amount | Fresh Fog | Sensitivity | Preserved for 3 days at 50° C., 80% RH Fog | Sensitivity | Classification |
|---|---|---|---|---|---|---|---|---|---|---|---|---|
| 14 | Em-2 | I-I | B | II-2 | B | II-43 | B | 0.08 | 130 | 0.18 | 120 | Invention |
| 15 | Em-2 | I-1 | C | II-2 | C | II-43 | C | 0.08 | 140 | 0.18 | 130 | Invention |
| 16 | Em-2 | I-1 | D | II-2 | D | II-43 | D | 0.08 | 140 | 0.19 | 125 | Invention |
| 17 | Em-3 | I-1 | C | II-2 | C | II-45 | C | 0.07 | 150 | 0.15 | 145 | Invention |
| 18 | Em-3 | I-3 | C | II-3 | C | II-2 | C | 0.08 | 135 | 0.18 | 120 | Invention |

Denotation of addition amount (common to Tables 4 and 5)
A: $0.90 \times 10^{-4}$
B: $0.60 \times 10^{-4}$
C: $0.72 \times 10^{-4}$
D: $0.84 \times 10^{-4}$
E: $1.08 \times 10^{-4}$
F: $1.26 \times 10^{-4}$ As apparent from Tables 4 and 5, samples 14 to 18 using three types of sensitizing dyes represented by Formulas I and II had higher sensitivities and did not undergo much deterioration in sensitivity even when preserved under high temperature and high humidity conditions, as compared with samples 1, 8, 9, 10 using two types of symmetrical dyes, samples 2, 3, 11, 12 using one type each of symmetrical dye and unsymmetrical dye, and samples 4, 13 using two types of symmetrical dyes together with an unsymmetrical dye of which ring structure is not common to the symmetrical ones. These advantages are attributed to less desorption of sensitizing dyes.

Further, samples 14 to 16 using the tabular silver halide emulsion according to the invention containing the sensitizing dyes represented by Formulas I and II did not undergo much desensitization and gave sensitivities higher than those of samples 5 to 7 using emulsions of octahedral grains, even when the amount of sensitizing dyes was increased. This shows that the samples of the invention are more stable in preservation under high temperature and high humidity conditions.

It is also apparent, from the results with samples 17 and 18, that desensitization under high temperature and high humidity conditions becomes much smaller when an emulsion of the invention comprised of grains grown by feeding silver halide fine grains is used.

In addition to the above samples, samples 19 to 62 were prepared in similar manners as with samples 1 to 18. Components of these samples are summarized in Table 6, and structures of the couplers are shown below.

TABLE 6

| Sample No | Emulsion | Sensitizing dye [I] | [II] | | Coupler |
|---|---|---|---|---|---|
| 19 to 23<br>24 to 28<br>29 | Em-1<br>Em-2<br>Em-3 | I-30<br>or D-2 | II-25 | II-50 | M-1 |
| 30 to 34<br>35 to 39<br>40 | Em-1<br>Em-2<br>Em-3 | I-10<br>or D-3 | II-3 | II-45 | |
| 41 to 45<br>46 to 50<br>51 | Em-1<br>Em-2<br>Em-3 | I-44<br>or D-4 | II-32 | II-62 | C-1 |
| 52 to 56<br>57 to 61<br>62 | Em-1<br>Em-2<br>Em-3 | I-54<br>or D-5 | II-70 | II-85 | Y-1 |

C-1

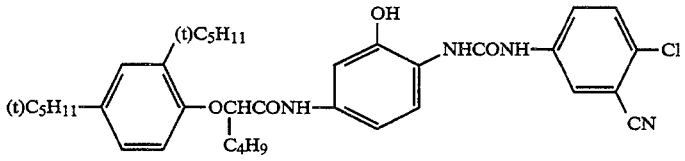

Y-1

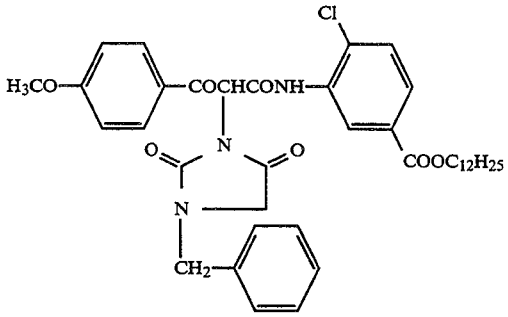

TABLE 6-continued

M-1

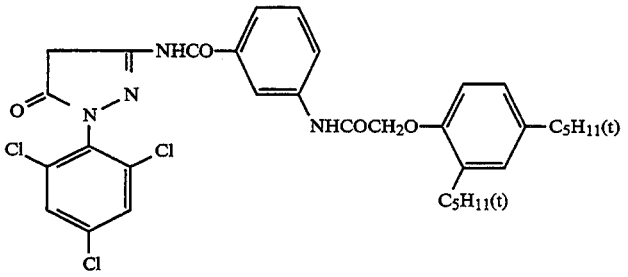

Samples 19 to 62 were evaluated in the same procedure as with samples 1 to 18, except that the exposure was performed using a green filter for samples 19 to 40, a red filter for samples 41 to 51, and a blue filter for samples 52 to 62. The results of the evaluation showed that the samples, which were prepared by use of emulsions containing the three types of sensitizing dyes according to the invention and comprised of tabular silver halide grains according to the invention grown by feeding silver halide fine grains, had a high sensitivity and did not deteriorate in sensitivity even when preserved at a high temperature and a high humidity.

Example 2

A multilayered color photographic light-sensitive material, sample 101, was prepared by forming the following layers in sequence on a triacethylcellulose film support.

| Sample 101 for comparison | |
|---|---|
| 1st layer: antihalation layer HC-1 | |
| Black colloidal silver | 0.18 |
| UV absorbent UV-1 | 0.23 |
| High boiling solvent Oil-1: dioctyl phthalate | 0.18 |
| Gelatin | 1.42 |
| 2nd layer: intermediate layer IL-1 | |
| Gelatin | 1.27 |
| 3rd layer: | |
| low-speed red-sensitive emulsion layer RL | |
| Silver iodobromide emulsion Em-4 | 0.20 |
| Silver iodobromide emulsion Em-5 | 0.78 |
| Sensitizing dye SD-1 | $1.8 \times 10^{-5}$ |
| Sensitizing dye SD-2 | $2.8 \times 10^{-4}$ |
| Sensitizing dye SD-3 | $1.9 \times 10^{-4}$ |
| Sensitizing.dye.SD-4 | $1.1 \times 10^{-4}$ |
| Cyan coupler C-1 | 0.70 |
| Colored cyan coupler CC-1 | 0.066 |
| DIR compound D-1 | 0.028 |
| High boiling solvent Oil-1 | 0.64 |
| Gelatin | 1.18 |
| 4th layer: | |
| medium-speed red-sensitive emulsion layer RM | |
| Silver iodobromide emulsion Em-6 | 0.78 |
| Sensitizing dye SD-1 | $2.1 \times 10^{-5}$ |
| Sensitizing dye SD-2 | $1.9 \times 10^{-4}$ |
| Sensitizing dye SD-3 | $9.6 \times 10^{-5}$ |
| Sensitizing dye SD-4 | $9.6 \times 10^{-5}$ |
| Cyan coupler C-1 | 0.28 |
| Colored cyan coupler CC-1 | 0.027 |
| DIR compound D-1 | 0.011 |
| High boiling solvent Oil-1 | 0.26 |
| Gelatin | 0.58 |
| 5th layer: high-speed red-sensitive emulsion layer RH | |
| Silver iodobromide emulsion Em-1 | 1.73 |
| Sensitizing dye II-32 | $0.9 \times 10^{-4}$ |
| Sensitizing dye II-62 | $0.9 \times 10^{-4}$ |
| Cyan coupler C-2 | 0.14 |
| DIR compound D-1 | 0.025 |

-continued

| Sample 101 for comparison | |
|---|---|
| High boiling solvent Oil-1 | 0.17 |
| Gelatin | 1.24 |
| 6th layer: intermediate layer IL-2 | |
| Gelatin | 0.80 |
| 7th layer: | |
| low-speed green-sensitive emulsion layer GL | |
| Silver iodobromide emulsion Em-4 | 0.11 |
| Silver iodobromide emulsion Em-5 | 0.98 |
| Sensitizing dye SD-4 | $6.8 \times 10^{-5}$ |
| Sensitizing dye SD-5 | $6.2 \times 10^{-4}$ |
| Magenta coupler M-1 | 0.54 |
| Magenta coupler M-2 | 0.19 |
| Colored magenta coupler CM-1 | 0.06 |
| DIR compound D-2 | 0.017 |
| High boiling solvent Oil-2: | 0.81 |
| tricresyl phosphate Gelatin | 1.77 |
| 8th layer: | |
| medium-speed green-sensitive emulsion layer GM | |
| Silver iodobromide emulsion Em-6 | 0.66 |
| Sensitizing dye SD-4 | $8.2 \times 10^{-5}$ |
| Sensitizing dye SD-6 | $1.9 \times 10^{-4}$ |
| Sensitizing dye SD-7 | $1.2 \times 10^{-4}$ |
| Sensitizing dye SD-8 | $1.5 \times 10^{-5}$ |
| Magenta coupler M-1 | 0.074 |
| Magenta coupler M-2 | 0.034 |
| Colored magenta coupler CM-1 | 0.043 |
| DIR compound D-2 | 0.018 |
| High boiling solvent Oil-2 | 0.30 |
| Gelatin | 0.76 |
| 9th layer: | |
| high-speed green-sensitive emulsion layer GH | |
| Silver iodobromide emulsion Em-1 | 1.66 |
| Sensitizing dye II-2 | $0.9 \times 10^{-4}$ |
| Sensitizing dye II-43 | $0.9 \times 10^{-4}$ |
| Magenta coupler M-1 | 0.094 |
| Magenta coupler M-3 | 0.044 |
| Colored magenta coupler CM-1 | 0.038 |
| High boiling solvent Oil-2 | 0.31 |
| Gelatin | 1.23 |
| 10th layer: yellow filter layer YC | |
| Yellow colloidal silver | 0.05 |
| Antistain agent | 0.1 |
| SC-1: 2-secondary-octadecyl-5-methylhydroquinone | |
| High boiling solvent Oil-2 | 0.125 |
| Gelatin | 1.33 |
| Formalin scavenger HS-1: 5-ureidohydantoin | 0.088 |
| Formalin scavenger HS-2: hydantoin | 0.066 |
| 11th layer: | |
| low-speed blue-sensitive emulsion layer BL | |
| Silver iodobromide emulsion Em-3 | 0.12 |
| Silver iodobromide emulsion Em-5 | 0.24 |
| Silver iodobromide emulsion Em-6 | 0.12 |
| Sensitizing dye SD-9 | $5.2 \times 10^{-4}$ |
| Sensitizing dye SD-10 | $1.9 \times 10^{-5}$ |
| Yellow coupler Y-1 | 0.65 |
| Yellow coupler Y-2 | 0.24 |
| High boiling solvent Oil-2 | 0.18 |
| Gelatin | 1.25 |
| Formalin scavenger HS-1 | 0.08 |
| 12th layer: | |

-continued

| Sample 101 for comparison | |
|---|---|
| high-speed blue-sensitive emulsion layer BH | |
| Silver iodobromide emulsion Em-1 | 0.95 |
| Sensitizing dye II-70 | $1.0 \times 10^{-4}$ |
| Sensitizing dye II-85 | $1.0 \times 10^{-4}$ |
| Yellow coupler Y-1 | 0.18 |
| High boiling solvent Oil-2 | 0.074 |
| Gelatin | 1.30 |
| Formalin scavenger HS-1 | 0.05 |
| Formalin scavenger HS-2 | 0.12 |
| 13th layer: 1st protective layer Pro-1 | |
| Fine grain silver iodobromide emulsion (average grain size: 0.08 μm, AgI content: 1 mol %) | 0.4 |
| UV absorvent UV-1 | 0.065 |
| UV absorbent UV-2 | 0.10 |

-continued

| Sample 101 for comparison | |
|---|---|
| High boiling solvent Oil-1 | 0.07 |
| High boiling solvent Oil-3: dibutyl phthalate | 0.07 |
| Formalin scavenger HS-1 | 0.13 |
| Formalin scavenger HS-2 | 0.37 |
| Gelatin | 1.31 |
| 14th layer: 2nd protective layer Pro-2 | |
| Alkali-soluble matting agent average particle size: 2 μm | 0.13 |
| Polymethylmethacrylate average particle size: 3 μm | 0.02 |
| Lubricant WAX-1 | 0.04 |
| Gelatin | 0.55 |

The compounds used in sample 101 were as follows:

C-1

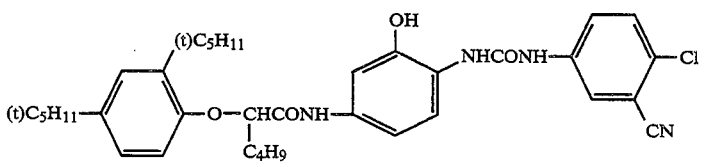

C-2

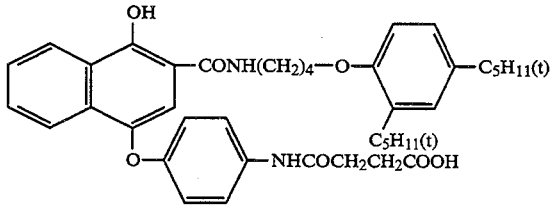

M-1

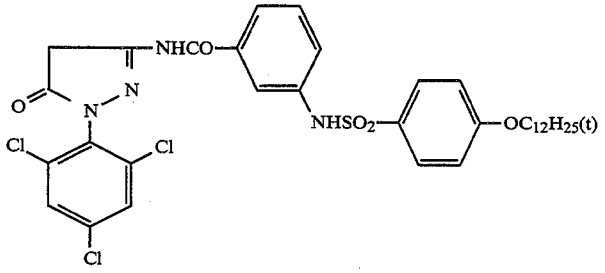

M-2

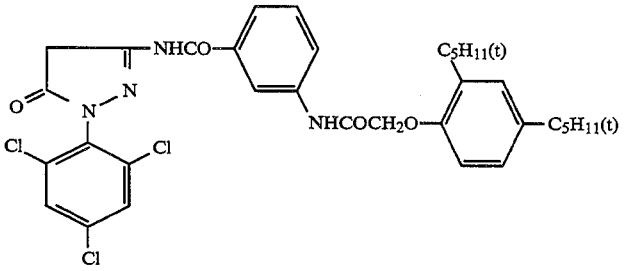

M-3

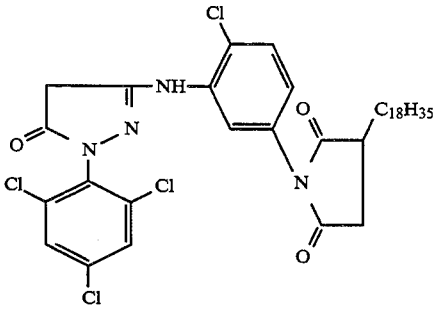

Y-1

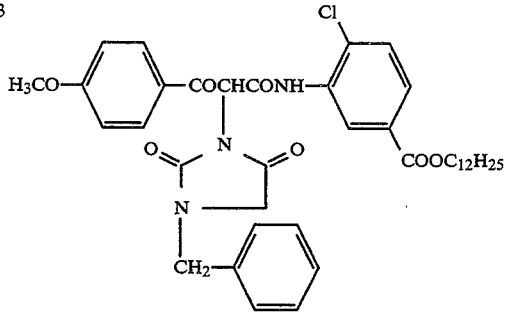

-continued
Y-2
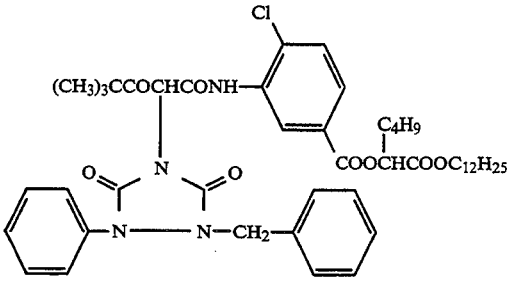
CC-1
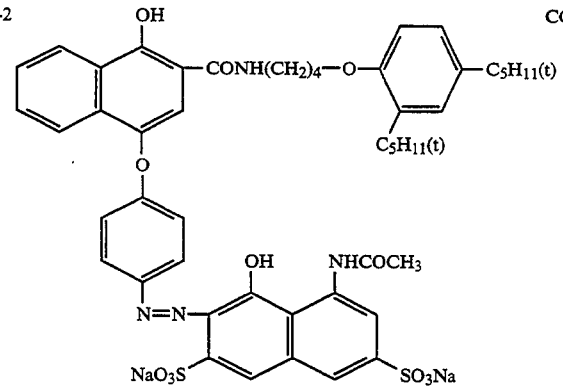
CM-1
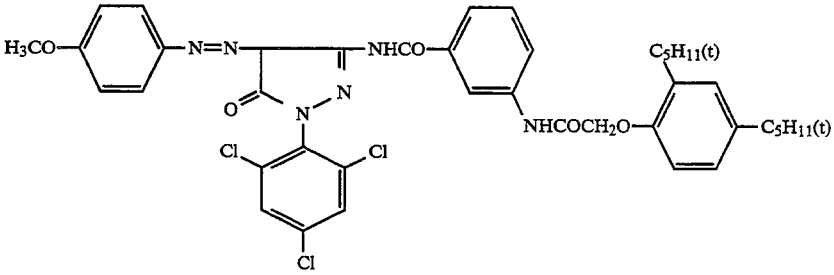
D-1
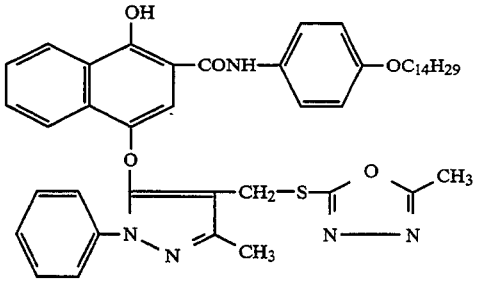
D-2
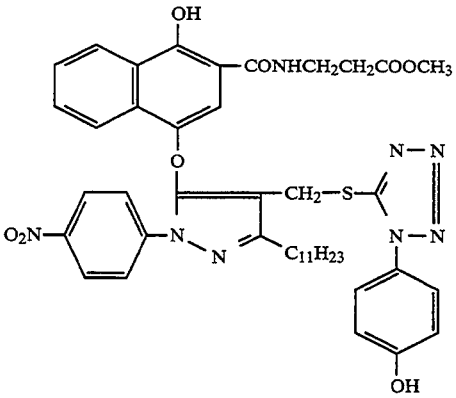
SC-1
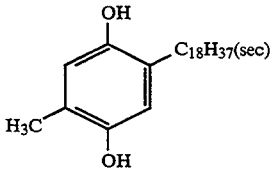
UV-1
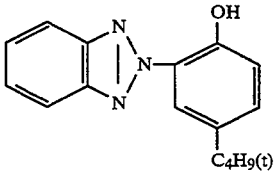
UV-2
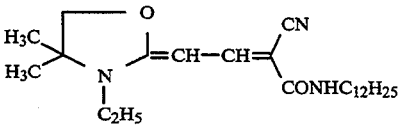
WAX-1
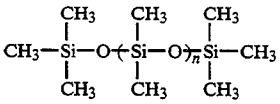
Weight average molecular weight = 3,000
(SD-1)
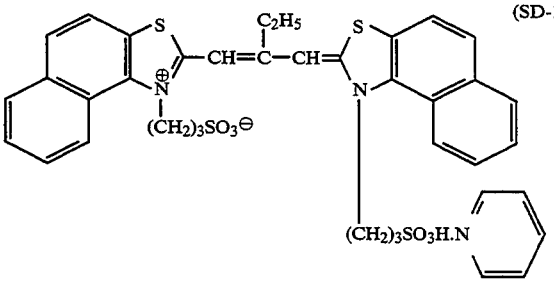
(SD-2)
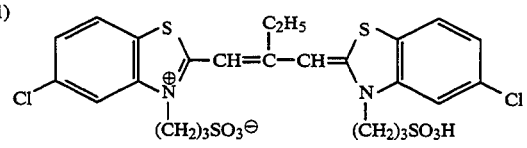

-continued (SD-3)

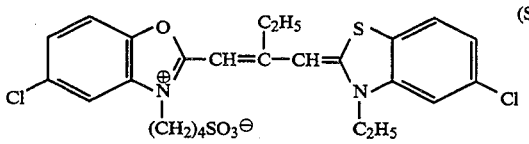

(SD-4)

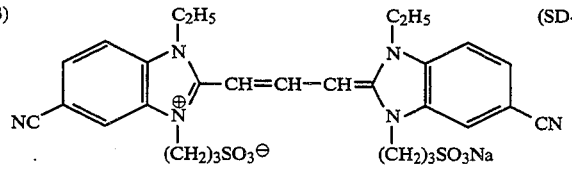

(SD-5)

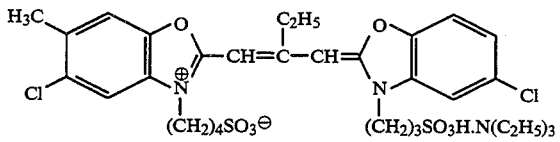

(SD-6)

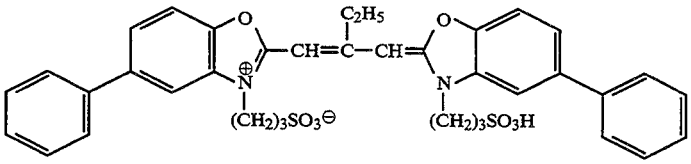

(SD-7)

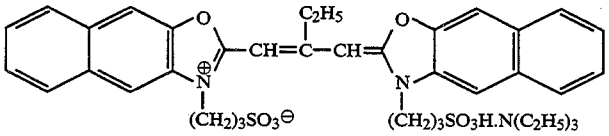

(SD-8)

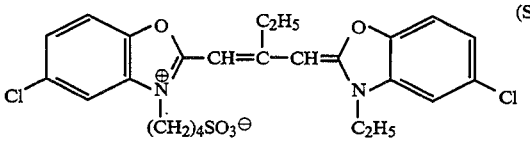

(SD-9)

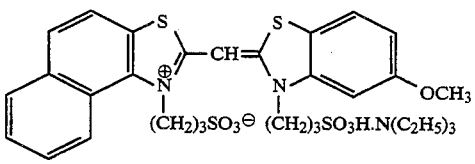

(SD-10)

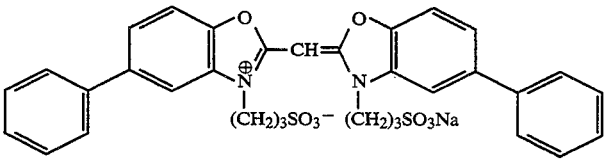

Besides the above compositions, there were added a coating aid (sodium dioctylsulfosuccinate), a dispersant (sodium tri(isopropyl)naphthalenesulfonate), a viscosity regulator, hardeners (sodium 2,4-dichloro-6-hydroxy-s-triazine and di(vinylsulfonylmethyl)ether), a stabilizer (TAI), an antifoggant (1-phenyl-5-mercaptotetrazole) and two types of poly-N-vinylpyrrolidones having respective molecular weights of 10,000 and 1,100,000.

Next, samples 102 to 111 were prepared in the same manner as with sample 101, except that the type and the addition amount of sensitizing dyes used in the high-speed blue-sensitive emulsion layer (BH), the high-speed green-sensitive emulsion layer (GH) and the high-speed red-sensitive emulsion layer (RH) of sample 101 were varied as shown in Tables 7 and 8.

TABLE 7

| | | | Sensitizing dye and its addition amount (mol/mol AgX) | | | | | | |
|---|---|---|---|---|---|---|---|---|---|
| | | | Formula I | | Formula II | | | | |
| Sample No | Emulsion layer | Emulsion | No | Amount | No. | Amount | No. | Amount | |
| 101 | BH | Em-1 | — | — | II-70 | A | II-85 | A | Comparison |
| | GH | Em-1 | — | — | II-2 | B | II-43 | B | |
| | RH | Em-1 | — | — | II-32 | B | II-62 | B | |
| 102 | BH | Em-1 | I-54 | A | — | — | II-85 | A | Comparison |
| | GH | Em-1 | I-1 | B | — | — | II-43 | B | |
| | RH | Em-1 | I-44 | B | — | — | II-62 | B | |
| 103 | BH | Em-1 | I-54 | A | II-70 | A | — | — | Comparison |
| | GH | Em-1 | I-1 | B | II-2 | B | — | — | |
| | RH | Em-1 | I-44 | B | II-32 | B | — | — | |
| 104 | BH | Em-1 | D-5 | C | II-70 | C | II-85 | C | Comparison |
| | GH | Em-1 | D-1 | D | II-2 | D | II-43 | D | |
| | RH | Em-1 | D-4 | D | II-32 | D | II-62 | D | |
| 105 | BH | Em-1 | I-54 | C | II-70 | C | II-85 | C | Comparison |
| | GH | Em-1 | I-1 | D | II-2 | D | II-43 | D | |
| | RH | Em-1 | I-44 | D | II-32 | D | II-62 | D | |

TABLE 7-continued

| Sample No | Emulsion layer | Emulsion | Sensitizing dye and its addition amount (mol/mol AgX) Formula I No | Formula I Amount | Formula II No. | Formula II Amount | Formula II No. | Formula II Amount | |
|---|---|---|---|---|---|---|---|---|---|
| 106 | BH | Em-2 | — | — | II-70 | A | II-85 | A | Comparison |
| | GH | Em-2 | — | — | II-2 | B | II-43 | B | |
| | RH | Em-2 | — | — | II-32 | B | II-62 | B | |
| 107 | BH | Em-2 | I-54 | A | — | — | II-85 | A | Comparison |
| | GH | Em-2 | I-1 | B | — | — | II-43 | B | |
| | RH | Em-2 | I-44 | B | — | — | II-62 | B | |

TABLE 8

| Sample No | Emulsion layer | Emulsion | Sensitizing dye and its addition amount (mol/mol AgX) Formula I No | Formula I Amount | Formula II No. | Formula II Amount | Formula II No. | Formula II Amount | |
|---|---|---|---|---|---|---|---|---|---|
| 108 | BH | Em-2 | I-54 | A | II-70 | A | — | — | Comparison |
| | GH | Em-2 | I-1 | B | II-2 | B | — | — | |
| | RH | Em-2 | I-44 | B | II-32 | B | — | — | |
| 109 | BH | Em-2 | D-5 | C | II-70 | C | II-85 | C | Comparison |
| | GH | Em-2 | D-1 | D | II-2 | D | II-43 | D | |
| | RH | Em-2 | D-4 | D | II-32 | D | II-62 | D | |
| 110 | BH | Em-2 | I-54 | E | II-70 | E | II-85 | E | Invention |
| | GH | Em-2 | I-1 | F | II-2 | F | II-43 | F | |
| | RH | Em-2 | I-44 | F | II-32 | F | II-62 | F | |
| 111 | BH | Em-3 | I-54 | E | II-70 | E | II-85 | E | Invention |
| | GH | Em-3 | I-1 | F | II-2 | F | II-43 | F | |
| | RH | Em-3 | I-44 | F | II-32 | F | II-62 | F | |

Denotation of addition amount (common to Tables 7 and 8)
A: $1.0 \times 10^{-4}$
B: $0.9 \times 10^{-4}$
C: $0.67 \times 10^{-4}$
D: $0.06 \times 10^{-4}$
E: $0.8 \times 10^{-4}$
F: $0.72 \times 10^{-4}$
The emulsions used in samples 101 to 111 were as follows:
Em-1, Em-2 and Em-3 were prepared by methods described in Preparation examples 1, 2 and 3, respectively.

| Emulsion No | Average AgI content (mol %) | Average grain size (μm) | Crystal Habit |
|---|---|---|---|
| Em-4 | 2 | 0.3 | Octahedron |
| Em-5 | 8 | 0.4 | Octahedron |
| Em-6 | 8 | 0.7 | Octahedron |

The average grain size is given in sizes when grains are converted into cubes.

The above emulsions were chemically ripened under optimum conditions using sodium thiosulfate, chloroauric acid and ammonium thiocyanate.

The samples prepared were evaluated in the same manner as in Example 1, except that each sample was wedgewise exposed through a blue filter, a green filter and a red filter.

The evaluation results are shown in Table 9. The sensitivities are shown by values relative to the sensitivity of each spectrally sensitive layer of sample 101, which is set at 100.

TABLE 9

| Sample No | Fresh B Fog | Fresh B Sensitivity | Fresh G Fog | Fresh G Sensitivity | Fresh R Fog | Fresh R Sensitivity | Preserved for 3 days at 50° C., 80% RH B Fog | Preserved B Sensitivity | Preserved G Fog | Preserved G Sensitivity | Preserved R Fog | Preserved R Sensitivity | |
|---|---|---|---|---|---|---|---|---|---|---|---|---|---|
| 101 | 0.65 | 100 | 0.50 | 100 | 0.24 | 100 | 0.75 | 65 | 0.60 | 70 | 0.33 | 65 | Comparison |
| 102 | 0.64 | 95 | 0.50 | 100 | 0.25 | 95 | 0.75 | 65 | 0.59 | 70 | 0.34 | 60 | Comparison |
| 103 | 0.64 | 90 | 0.51 | 100 | 0.25 | 95 | 0.74 | 55 | 0.60 | 70 | 0.34 | 60 | Comparison |
| 104 | 0.65 | 100 | 0.51 | 100 | 0.24 | 100 | 0.74 | 65 | 0.61 | 75 | 0.34 | 70 | Comparison |
| 105 | 0.64 | 110 | 0.50 | 110 | 0.24 | 115 | 0.73 | 85 | 0.60 | 90 | 0.33 | 70 | Comparison |
| 106 | 0.65 | 110 | 0.50 | 110 | 0.23 | 115 | 0.72 | 75 | 0.58 | 85 | 0.32 | 80 | Comparison |
| 107 | 0.63 | 105 | 0.49 | 110 | 0.23 | 105 | 0.70 | 70 | 0.57 | 80 | 0.31 | 75 | Comparison |
| 108 | 0.63 | 105 | 0.49 | 115 | 0.22 | 105 | 0.70 | 70 | 0.58 | 80 | 0.30 | 75 | Comparison |
| 109 | 0.63 | 110 | 0.49 | 110 | 0.21 | 110 | 0.71 | 85 | 0.57 | 90 | 0.30 | 80 | Comparison |
| 110 | 0.58 | 145 | 0.46 | 140 | 0.18 | 145 | 0.62 | 135 | 0.53 | 130 | 0.23 | 135 | Invention |
| 111 | 0.57 | 150 | 0.45 | 150 | 0.16 | 145 | 0.60 | 145 | 0.51 | 145 | 0.20 | 140 | Invention |

As apparent from the results shown in Table 9, samples 105, 110, 111 using three types of sensitizing dyes represented by Formulas I and II had higher sensitivities and did not deteriorate in sensitivity even when preserved under high temperature and high humidity conditions, as compared with samples 101, 106 using two types of symmetrical dyes, samples 102, 103, 107, 108 using one type each of symmetrical dye and unsymmetrical dye, and samples 104, 109 using two types of symmetrical dyes together with one unsymmetrical dye of which ring structure is not common to the symmetrical ones. These advantages are attributed to less desorption of sensitizing dyes.

It can also be seen that sample 110, in which the three types of sensitizing dyes of the invention and the tabular silver halide emulsion according to the invention were combined, could receive a larger amount of sensitizing dyes because of the increase in grain surface area, and that this led to a small degree of desensitization under high temperature and high humidity conditions that could not be obtained with the silver halide emulsion irrelevant to the invention.

As apparent from the results with sample 111, a much higher sensitivity and a much better preservability could be obtained by growing silver halide grains through the feed of fine grains.

Example 3

A multilayered color photographic light-sensitive material, sample 201, was prepared by forming the following layers in sequence on a triacetylcellulose film support.

| Sample 201 | |
|---|---|
| 1st layer: antihalation layer HC | |
| Black colloidal silver | 0.18 |
| Gelatin | 1.57 |
| UV absorbent UV-1 | 0.17 |
| High boiling solvent Oil-1: dioctyl phthalate | 0.14 |
| 2nd layer: 1st intermediate layer IL-1 | |
| Gelatin | 1.00 |
| 3rd layer: 1st red-sensitive emulsion layer RL | |
| Silver iodobromide emulsion Em-7 | 0.66 |
| Silver iodobromide emulsion Em-6 | 0.29 |
| Gelatin | 1.29 |
| Sensitizing dye S-1 | $3.21 \times 10^{-4}$ |
| Sensitizing dye S-2 | $2.71 \times 10^{-4}$ |
| Sensitizing dye S-3 | $3.45 \times 10^{-5}$ |
| Coupler C-1 | 0.96 |
| Colored coupler CC-1 | 0.07 |
| High boiling solvent Oil-1 | 0.52 |
| 4th layer: 2nd intermediate layer IL-2 | |
| Gelatin | 0.75 |
| 5th layer: 1st green-sensitive emulsion layer GL | |
| Silver iodobromide emulsion Em-7 | 0.66 |
| Silver iodobromide emulsion Em-6 | 0.29 |
| Gelatin | 1.08 |
| Sensitizing dye S-4 | $2.67 \times 10^{-4}$ |
| Sensitizing dye S-5 | $2.23 \times 10^{-4}$ |
| Sensitizing dye S-6 | $4.48 \times 10^{-5}$ |
| Sensitizing dye S-7 | $7.04 \times 10^{-6}$ |
| Coupler M-1 | 0.13 |
| Coupler M-2 | 0.29 |
| Colored coupler CM-1 | 0.082 |
| High boiling solvent | 0.51 |
| Oil-2: tricresyl phosphate | |
| 6th layer: 2nd green-sensitive emulsion layer GM | |
| Silver iodobromide emulsion Em-8 | 0.76 |
| Gelatin | 0.80 |
| Sensitizing dye S-4 | $1.45 \times 10^{-4}$ |
| Sensitizing dye S-5 | $1.21 \times 10^{-4}$ |
| Sensitizing dye S-6 | $2.43 \times 10^{-5}$ |
| Sensitizing dye S- | $3.82 \times 10^{-6}$ |
| Coupler M-1 | 0.036 |
| Coupler M-2 | 0.077 |
| Colored coupler CM-1 | 0.035 |
| High boiling solvent Oil-2 | 0.15 |
| 7th layer: 3rd intermediate layer IL-3 | |
| Gelatin | 0.55 |
| SC-1 | 0.032 |
| 8th layer: 1st blue-sensitive layer BL | |
| Silver iodobromide emulsion Em-7 | 0.76 |
| Gelatin | 1.16 |
| Sensitizing dye S-8 | $2.88 \times 10^{-4}$ |
| Sensitizing dye S-9 | $7.19 \times 10^{-5}$ |
| Coupler Y-1 | 0.40 |
| High boiling solvent Oil-2 | 0.16 |

-continued

| Sample 201 | |
|---|---|
| 9th layer: 4th intermediate layer IL-4 | |
| Gelatin | 0.75 |
| SC-1 | 0.044 |
| 10th layer: 2nd red-sensitive emulsion layer RM | |
| Silver iodobromide emulsion Em-8 | 0.95 |
| Gelatin | 0.93 |
| Sensitizing dye S-1 | $1.74 \times 10^{-4}$ |
| Sensitizing dye S-2 | $1.74 \times 10^{-5}$ |
| Sensitizing dye S-3 | $1.87 \times 10^{-5}$ |
| Coupler C-1 | 0.33 |
| High boiling solvent Oil-1 | 0.33 |
| 11th layer: 3rd red-sensitive emulsion layer RH | |
| Silver iodobromide emulsion Em-1 | 2.30 |
| Gelatin | 1.49 |
| Sensitizing dye II-32 | $0.90 \times 10^{-4}$ |
| Sensitizing dye II-62 | $0.90 \times 10^{-5}$ |
| Coupler C-2 | 0.19 |
| SC-1 | 0.027 |
| High boiling solvent Oil-1 | 0.43 |
| 12th layer: 5th intermediate layer IL-5 | |
| Gelatin | 0.75 |
| SC-1 | 0.044 |
| 13th layer: 3rd green-sensitive emulsion layer GH | |
| Silver iodobromide emulsion Em-1 | 1.82 |
| Gelatin | 0.62 |
| Sensitizing dye II-2 | $0.9 \times 10^{-4}$ |
| Sensitizing dye II-43 | $0.9 \times 10^{-4}$ |
| Coupler M-3 | 0.06 |
| Coupler M-2 | 0.13 |
| Colored coupler CM-1 | 0.01 |
| High boiling solvent Oil-2 | 0.35 |
| 14th layer: 6th intermediate layer IL-6 | |
| Gelatin | 0.75 |
| SC-1 | 0.044 |
| 15th layer: 2nd blue-sensitive emulsion layer BM | |
| Silver iodobromide emulsion Em-8 | 1.06 |
| Gelatin | 0.925 |
| Sensitizing dye S-8 | $2.17 \times 10^{-4}$ |
| Sensitizing dye S-9 | $1.12 \times 10^{-5}$ |
| Coupler Y-1 | 0.31 |
| High boiling solvent Oil-2 | 0.13 |
| 16th layer: 3rd blue-sensitive emulsion layer BH | |
| Silver iodobromide emulsion Em-1 | 1.84 |
| Gelatin | 1.10 |
| Sensitizing dye II-70 | $1.0 \times 10^{-4}$ |
| Sensitizing dye II-85 | $1.0 \times 10^{-4}$ |
| Coupler Y-1 | 0.52 |
| High boiling solvent Oil-2 | 0.21 |
| 17th layer: 1st protective layer Pro-1 | |
| Silver iodobromide emulsion Em-9 | 0.10 |
| Gelatin | 1.52 |
| UV absorbent UV-1 | 0.006 |
| UV absorbent UV-2 | 0.099 |
| High boiling solvent Oil-1 | 0.0065 |
| High boiling solvent | 0.0065 |
| Oil-3: dibutyl phthalate | |
| 18th layer: 2nd protective layer Pro-2 | |
| Gelatin | 0.55 |
| Alkali-soluble matting agent | 0.13 |
| Polymethylmethacrylate | 0.02 |
| Lubricant WAX-1 | 0.04 |

Besides the above compositions, there were added to each layer a coatig aid (Su-1), dispersants (sodium dioctylsulfosuccinate, sodium p-dodecylbenzenesulfonate), gelatin hardeners (sodium 2,4-dichloro-6-hydroxy-s-triazine, divinylsulfonylmethyl ether), a stabilizer (TAI), antifoggants (1-phenyl-5-mercaptotetrazole, 1-(2-pyridyl)-tetrazole) and an antiseptic agent (DI-1).

The structural formulas of the compounds contained in the layers of sample 201 to 211 are as follows:

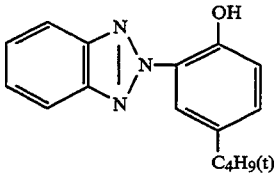
UV-1
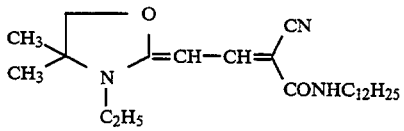
UV-2
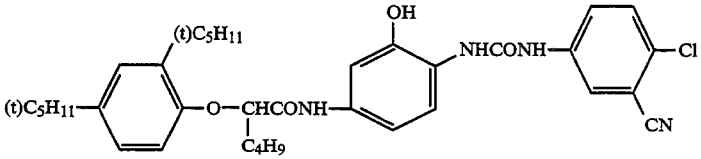
C-1
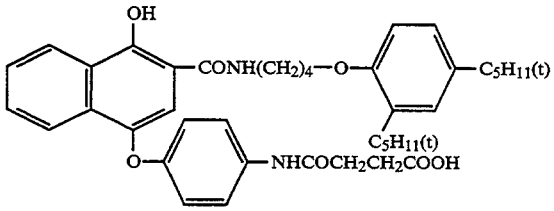
C-2
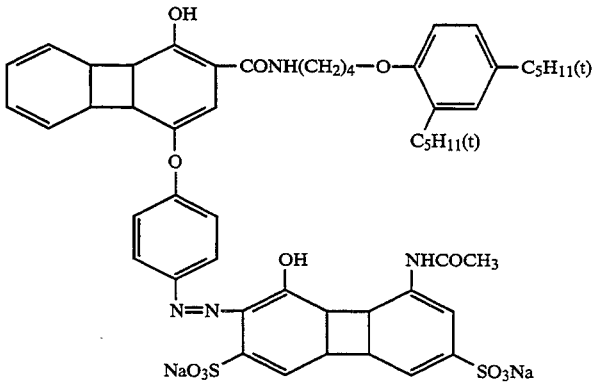
CC-1
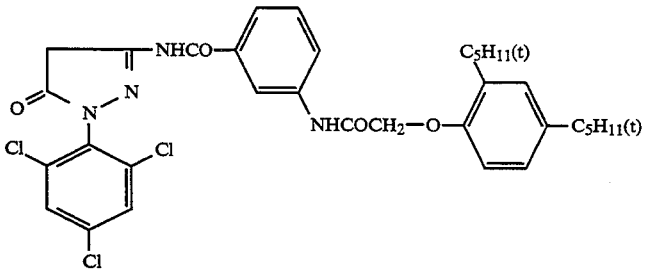
M-1
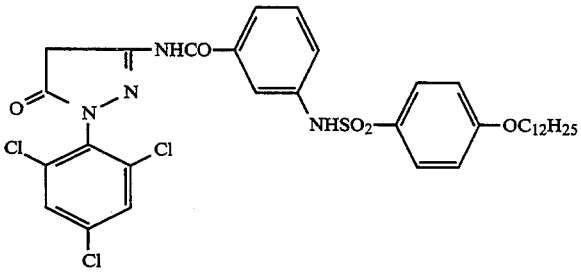
M-2

-continued
M-3
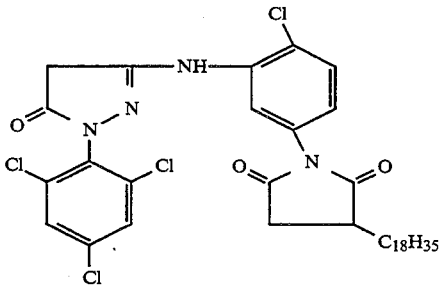
Y-1
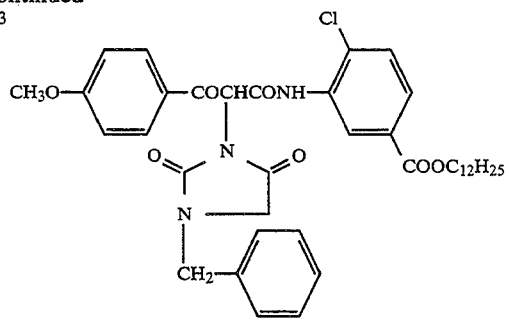
CM-1
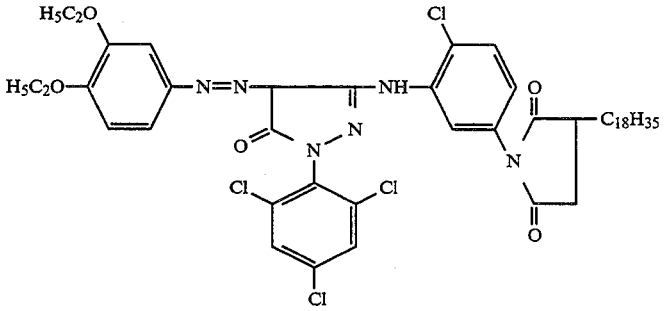
D-1
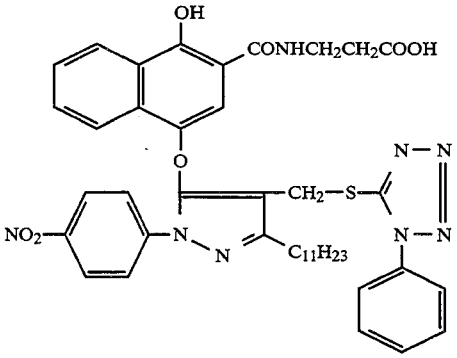
D-2
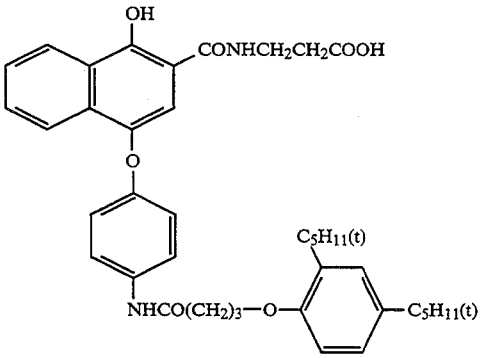
S-1
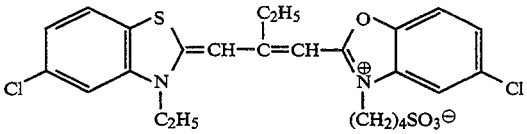
S-2
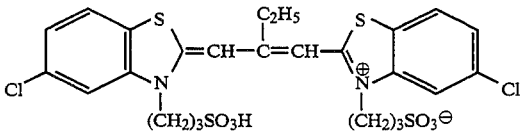
S-3
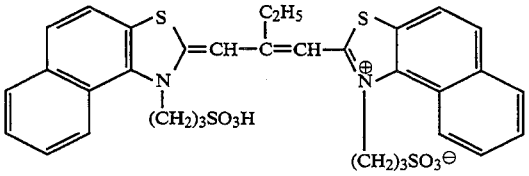
S-4
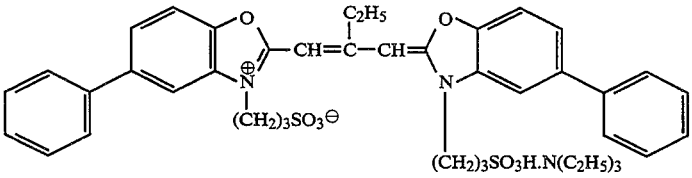
S-5
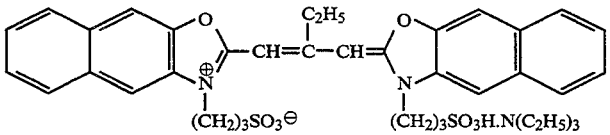

-continued

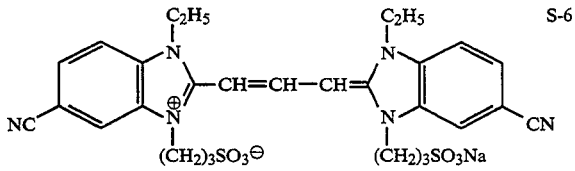
S-6

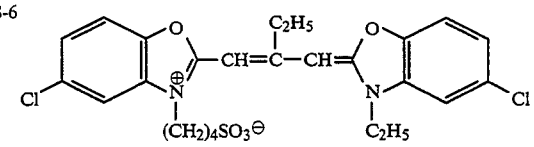
S-7

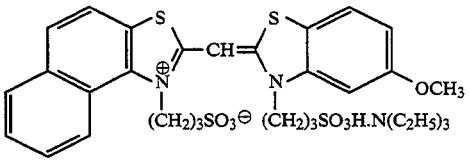
S-8

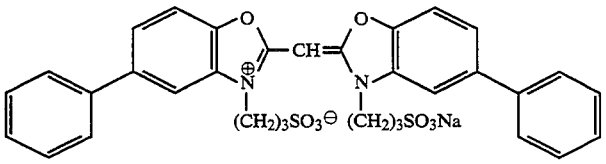
S-9

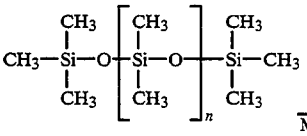
WAX-1

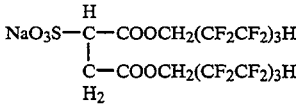
Su-1

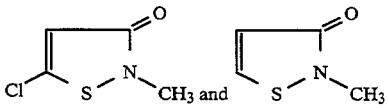
DI-1

Subsequently, samples 202 to 211 were prepared in the same manner as with sample 201, except that the type and the addition amount of sensitizing dyes used in the 3rd blue-sensitive emulsion layer (BH), the 3rd green-sensitive emulsion layer (GH) and the 3rd red-sensitive emulsion layer (RH) of sample 201 were varied as shown in Tables 10 and 11.

TABLE 10

| | | | Sensitizing dye and its addition amount (mol/mol AgX) | | | | | | |
|---|---|---|---|---|---|---|---|---|---|
| | | | Formula I | | Formula II | | | | |
| Sample No | Emulsion layer | Emulsion | No | Amount | No. | Amount | No. | Amount | |
| 201 | BH | Em-1 | — | — | II-70 | A | II-85 | A | Comparison |
| | GH | Em-1 | — | — | II-2 | B | II-43 | B | |
| | RH | Em-1 | — | — | II-32 | B | II-62 | B | |
| 202 | BH | Em-1 | I-54 | A | — | — | II-85 | A | Comparison |
| | GH | Em-1 | I-1 | B | — | — | II-43 | B | |
| | RH | Em-1 | I-44 | B | — | — | II-62 | B | |
| 203 | BH | Em-1 | I-54 | A | II-70 | A | — | — | Comparison |
| | GH | Em-1 | I-1 | B | II-2 | B | — | — | |
| | RH | Em-1 | I-44 | B | II-32 | B | — | — | |
| 204 | BH | Em-1 | D-5 | C | II-70 | C | II-85 | C | Comparison |
| | GH | Em-1 | D-1 | D | II-2 | D | II-43 | D | |
| | RH | Em-1 | D-4 | D | II-32 | D | II-62 | D | |
| 205 | BH | Em-1 | I-54 | C | II-70 | C | II-85 | C | Comparison |
| | GH | Em-1 | I-1 | D | II-2 | D | II-43 | D | |
| | RH | Em-1 | I-44 | D | II-32 | D | II-62 | D | |
| 206 | BH | Em-2 | — | — | II-70 | A | II-85 | A | Comparison |
| | GH | Em-2 | — | — | II-2 | B | II-43 | B | |
| | RH | Em-2 | — | — | II-32 | B | II-62 | B | |
| 207 | BH | Em-2 | I-54 | A | — | — | II-85 | A | Comparison |
| | GH | Em-2 | I-1 | B | — | — | II-43 | B | |
| | RH | Em-2 | I-44 | B | — | — | II-62 | B | |

TABLE 11

| | | | Sensitizing dye and its addition amount (mol/mol AgX) | | | | | | |
|---|---|---|---|---|---|---|---|---|---|
| | | | Formula I | | Formula II | | | | |
| Sample No | Emulsion layer | Emulsion | No | Amount | No. | Amount | No. | Amount | |
| 208 | BH | Em-2 | I-54 | A | II-70 | A | — | — | Comparison |

TABLE 11-continued

| Sample No | Emulsion layer | Emulsion | Sensitizing dye and its addition amount (mol/mol AgX) Formula I No | Formula I Amount | Formula II No. | Formula II Amount | Formula II No. | Formula II Amount | |
|---|---|---|---|---|---|---|---|---|---|
| | GH | Em-2 | I-1 | B | II-2 | B | — | — | |
| | RH | Em-2 | I-44 | B | II-32 | B | — | — | |
| 209 | BH | Em-2 | D-5 | C | II-70 | C | II-85 | C | Comparison |
| | GH | Em-2 | D-1 | D | II-2 | D | II-43 | D | |
| | RH | Em-2 | D-4 | D | II-32 | D | II-62 | D | |
| 210 | BH | Em-2 | I-54 | E | II-70 | E | II-85 | E | Invention |
| | GH | Em-2 | I-1 | F | II-2 | F | II-43 | F | |
| | RH | Em-2 | I-44 | F | II-32 | F | II-62 | F | |
| 211 | BH | Em-3 | I-54 | E | II-70 | E | II-85 | E | Invention |
| | GH | Em-3 | I-1 | F | II-2 | F | II-43 | F | |
| | RH | Em-3 | I-44 | F | II-32 | F | II-62 | F | |

Denotation of addition amount (common to Tables 10 and 11)
A: $1.0 \times 10^{-4}$
B: $0.9 \times 10^{-4}$
C: $0.67 \times 10^{-4}$
D: $0.06 \times 10^{-4}$
E: $0.8 \times 10^{-4}$
F: $0.72 \times 10^{-4}$
The emulsions used in samples 201 to 211 were as follows:
Em-1, Em-2 and Em-3 were prepared by methods described in Preparation examples 1, 2 and 3, respectively.

| Emulsion No | Average grain size (μm) | Average AgI content (mol %) |
|---|---|---|
| Em-6 | 0.65 | 8 |
| Em-7 | 0.38 | 8 |
| Em-8 | 0.80 | 8 |
| Em-9 | 0.08 | 1 |

These were all monodispersed surface-silver-iodide-containing types. The average grain size is given in sizes when grains are converted into cubes.

The above emulsions were chemically ripened under optimum conditions using sodium thiosulfate, chloroauric acid and ammonium thiocyanate.

The samples prepared as above were evaluated in the same manner as in Example 1, except that each sample was wedgewise exposed through a blue filter, a green filter and a red filter.

The evaluation results are shown in Table 12, where the sensitivities are shown by values relative to the sensitivity of each spectrally sensitive layer of sample 201, which is set at 100.

TABLE 12

| Sample No | Fresh B Fog | Fresh B Sensitivity | Fresh G Fog | Fresh G Sensitivity | Fresh R Fog | Fresh R Sensitivity | Preserved for 3 days at 50° C., 80% RH B Fog | Preserved B Sensitivity | Preserved G Fog | Preserved G Sensitivity | Preserved R Fog | Preserved R Sensitivity | |
|---|---|---|---|---|---|---|---|---|---|---|---|---|---|
| 201 | 0.68 | 100 | 0.53 | 100 | 0.26 | 100 | 0.78 | 65 | 0.62 | 70 | 0.36 | 65 | Comparison |
| 202 | 0.67 | 90 | 0.53 | 95 | 0.27 | 90 | 0.77 | 60 | 0.62 | 65 | 0.35 | 55 | Comparison |
| 203 | 0.67 | 90 | 0.541 | 95 | 0.27 | 90 | 0.78 | 55 | 0.63 | 65 | 0.35 | 55 | Comparison |
| 204 | 0.68 | 100 | 0.54 | 100 | 0.26 | 100 | | 60 | 0.62 | 75 | 0.35 | 70 | Comparison |
| 205 | 0.68 | 110 | 0.53 | 110 | 0.26 | 115 | 0.78 | 80 | 0.62 | 90 | 0.35 | 90 | Comparison |
| 206 | 0.66 | 105 | 0.53 | 110 | 0.25 | 115 | 0.74 | 70 | 0.61 | 85 | 0.33 | 80 | Comparison |
| 207 | 0.66 | 110 | 0.52 | 110 | 0.25 | 110 | 0.74 | 75 | 0.60 | 80 | 0.33 | 80 | Comparison |
| 208 | 0.64 | 110 | 0.51 | 115 | 0.24 | 105 | 0.72 | 75 | 0.59 | 80 | 0.32 | 75 | Comparison |
| 209 | 0.65 | 115 | 0.51 | 110 | 0.23 | 110 | 0.72 | 85 | 0.59 | 90 | 0.31 | 80 | Comparison |
| 210 | 0.59 | 150 | 0.48 | 145 | 0.20 | 150 | 0.64 | 145 | 0.53 | 135 | 0.25 | 140 | Invention |
| 211 | 0.58 | 155 | 0.47 | 155 | 0.18 | 150 | 0.62 | 150 | 0.51 | 150 | 0.21 | 150 | Invention |

As apparent from the results shown in Table 12, samples 205, 210, 211 using three types of sensitizing dyes represented by Formulas I and II had higher sensitivities and did not deteriorate in sensitivity even when preserved under high temperature and high humidity conditions, as compared with samples 201, 206 using two types of symmetrical dyes, samples 202, 203, 207, 208 using one type each of symmetrical dye and unsymmetrical dye, and samples 204, 209 using two types of symmetrical dyes together with one unsymmetrical dye of which ring structure is not common to the symmetrical dyes. This effect is attributed to less desorption of sensitizing dyes.

Sample 210, in which three types of sensitizing dyes according to the invention were incorporated in tabular silver halide emulsions according to the invention, could receive a larger amount of sensitizing dyes because of the increase in grain surface area. As a result, the sample showed a higher sensitivity and a smaller degree of desensitization under high temperature and high humidity conditions when compared with the sample using a silver halide emulsion irrelevant to the invention.

As apparent from the results with sample 211, the method of growing silver halide grains by means of fine grain feeding could give a much higher sensitivity and a much better preservability.

What is claimed is:

1. A photographic silver halide emulsion comprising tabular silver halide grains having at least two twin crystal planes, and at least one of an unsymmetrical cyanine represented by Formula I, and at least one of a symmetrical cyanine represented by Formula II-(a), and at least one of a symmetrical cyanine represented by Formula II-(b), wherein said tabular silver halide grains are formed by feeding silver halide fine grains to a silver halide-containing seed emulsion:

Formula I

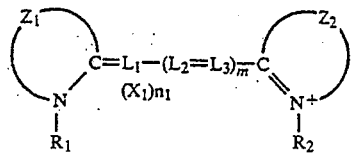

(a)

Formula II

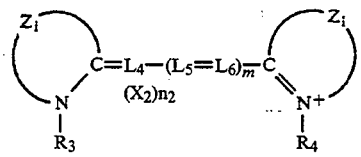

(b)

Formula II

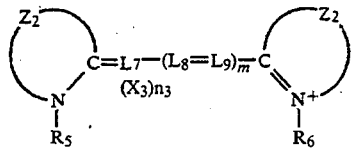

wherein $Z_1$ and $Z_2$ each represents a group of atoms which form with other atoms a naphthoxazole ring, a naphthothiazole ring, a naphthioimidazole ring, a naphthoselenazole ring, a benzoxazole ring, a benzothiazole ring, a benzimidazole ring, or a benzselenazole ring; $Z_1$ and $Z_2$ are not the same as each other; the heterocyclic rings formed by $Z_1$ and $Z_2$ may have a substituent group; $R_1$, $R_2$, $R_3$, $R_4$, $R_5$ and $R_6$ each represents an unsubstituted alkyl group or a substituted alkyl group; m represents an integer of 0 to 2, $L_1$ to $L_9$ each represents a methine group or a substituted methine group; $X_1$, $X_2$ and $X_3$ each represents a charge-balancing counter ion; $n_1$, $n_2$ and $n_3$ each represents an integer larger than 0 and necessary to neutralize the charge of the whole molecule.

2. A photographic silver halide emulsion of claim 1, wherein $Z_1$ of Formula I represents a group of atoms which form with other atoms a naphthoxazole ring, a naphthothiazole ring, a naphthoimidazole ring or a naphthoselenazole ring, and $Z_2$ of Formula II represents a group of atoms which form with other atoms a benzoxazole ring, a benzothiazole ring, a benzimidazole ring or a benzselenazole ring.

3. A photographic silver halide emulsion of claim 1, wherein the amount of the sensitizing dye represented by Formula I, Formula II-(a) and Formula II-(b) is $2\times10^{-6}$ to $1\times10^{-2}$ mol per mol of silver halide.

4. A photographic silver halide emulsion of claim 1, wherein the weight ratio of Formula I to Formula II-(a) and II-(b) is 0.05 to 20.

5. A photographic silver halide emulsion of claim 1, wherein the number of said tabular silver halide grains having at least two twin planes is not less than 50% with respect to the number of grains counted from the most abundant grain.

6. A photographic silver halide emulsion of claim 1, wherein the twin plane of said tabular silver halide grains is composed of the {111} face.

7. A photographic silver halide emulsion of claim 1, wherein the ratio of the diameter of said grain in terms of a circle to the thickness between the two parallel surfaces is 1 to 20.

8. A photographic silver halide emulsion of claim 1, wherein the average size of all silver halide grains is 0.1 μm to 10 μm along the edge of a cubic of identical volume.

9. A photographic silver halide emulsion of claim 1, wherein the average silver iodide content of said silver halide emulsion is 4 to 20 mol %.

10. A photographic silver halide emulsion of claim 1, wherein said silver halide emulsion is comprised of core/shell structure grains having a high silver iodide content phase and a low silver iodide content phase in the grains.

11. A photographic silver halide emulsion of claim 10, wherein the silver iodide content in said high silver iodide content phase is 15 to 45 mol %.

12. A photographic silver halide emulsion of claim 10, wherein the average silver iodide content of said low silver iodide content phase is not more than 6 mol %.

13. A photographic silver halide emulsion comprising tabular silver halide grains having at least two twin crystal planes, and at least one of an unsymmetrical cyanine represented by Formula I, and at least one of a symmetrical cyanine represented by Formula II-(a), and at least one of a symmetrical cyanine represented by Formula II-(b), wherein said tabular silver halide grains are formed by feeding silver halide fine grains to a silver halide-containing seed emulsion:

Formula I

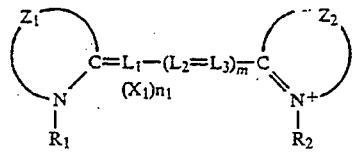

(a)

Formula II

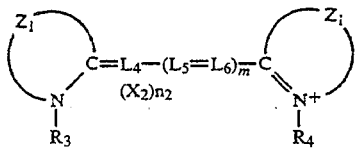

(b)

Formula II

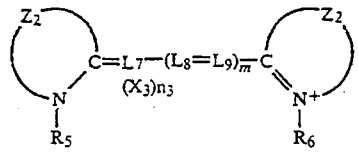

wherein $Z_1$ represents a group of atoms which form with other atoms a naphthoxazole ring, a naphthothiazole ring, a naphthioimidazole ring, or a naphthoselenazole ring, and $Z_2$ represents a group of atoms which form with other atoms a benzoxazole ring, a benzothiazole ring, a benzimidazole ring, or a benzselenazole ring; $Z_1$ and $Z_2$ are not the same as each other; the heterocyclic rings formed by $Z_1$ and $Z_2$ may have a substituent group; $R_1$, $R_2$, $R_3$, $R_4$, $R_5$ and $R_6$ each represents an unsubstituted alkyl group or a substituted alkyl group; m represents an integer of 0 to 2; $L_1$ to $L_9$ each represents a methine group or a substituted methine group; $X_1$, $X_2$ and $X_3$ each represents a charge-balancing counter ion; $n_1$, $n_2$ and $n_3$ each represents an integer larger than 0 and necessary to neutralize the charge of the whole molecule.

14. A silver halide photographic light-sensitive material which comprises a support and provided thereon a photographic silver halide emulsion layer, wherein said silver halide emulsion comprises tabular silver halide grains having at least two twin crystal planes, and at least one of an unsymmetrical cyanine represented by Formula I, and at least one of a symmetrical cyanine represented by Formula II-(a), and at least one of a symmetrical cyanine represented by Formula II-(b), wherein said tabular silver halide grains are formed by feeding silver halide fine grains to a silver halide-containing seed emulsion:

Formula I

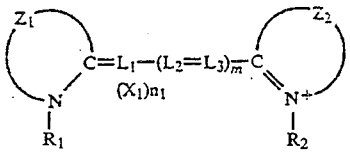

(a)

-continued

Formula II

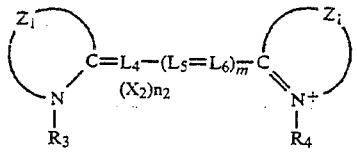

(b)

Formula II

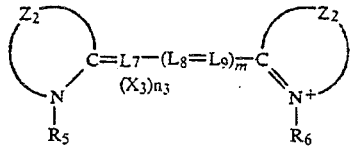

wherein $Z_1$ represents a group of atoms which form with other atoms a naphthoxazole ring, a naphthothiazole ring, a naphthioimidazole ring, or a naphthoselenazole ring, and $Z_2$ represents a group of atoms which form with other atoms a benzoxazole ring, a benzothiazole ring, a benzimidazole ring, or a benzselenazole ring; $Z_1$ and $Z_2$ are not the same as each other; the heterocyclic rings formed by $Z_1$ and $Z_2$ may have a substituent group; $R_1$, $R_2$, $R_3$, $R_4$, $R_5$ and $R_6$ each represents an unsubstituted alkyl group or a substituted alkyl group; m represents an integer of 0 to 2; $L_1$ to $L_9$ each represents a methine group or a substituted methine group; $X_1$, $X_2$ and $X_3$ each represents a charge-balancing counter ion; $n_1$, $n_2$ and $n_3$ each represents an integer larger than 0 and necessary to neutralize the charge of the whole molecule.

* * * * *

UNITED STATES PATENT AND TRADEMARK OFFICE

CERTIFICATE OF CORRECTION

PATENT NO. : 5,378,597

DATED : January 03, 1995

INVENTOR(S) : Satomi KAWABE et al

It is certified that error appears in the above-indentified patent and that said Letters Patent is hereby corrected as shown below:

Claim 8, Column 48, Line 1, "cubic" should read --cube--.

Signed and Sealed this

Twelfth Day of September, 1995

*Attest:*

Bruce Lehman

BRUCE LEHMAN

*Attesting Officer*

*Commissioner of Patents and Trademarks*